US012473905B2

(12) United States Patent
Bumby et al.

(10) Patent No.: US 12,473,905 B2
(45) Date of Patent: Nov. 18, 2025

(54) MICROFLUIDIC PUMP CONTROL

(71) Applicant: LEE VENTUS LIMITED, Royston (GB)

(72) Inventors: James Samuel Bumby, Royston (GB); Martin Croft, Royston (GB); William Deeks, Royston (GB); Stuart Andrew Hatfield, Royston (GB)

(73) Assignee: LEE VENTUS LIMITED, Royston (GB)

( * ) Notice: Subject to any disclaimer, the term of this patent is extended or adjusted under 35 U.S.C. 154(b) by 0 days.

(21) Appl. No.: 18/561,696

(22) PCT Filed: May 19, 2022

(86) PCT No.: PCT/GB2022/051274
§ 371 (c)(1),
(2) Date: Nov. 16, 2023

(87) PCT Pub. No.: WO2022/243697
PCT Pub. Date: Nov. 24, 2022

(65) Prior Publication Data

US 2024/0247651 A1 Jul. 25, 2024

(30) Foreign Application Priority Data

May 19, 2021 (GB) ..... 2107155

(51) Int. Cl.
*F04B 43/04* (2006.01)
*F04B 19/00* (2006.01)
(Continued)

(52) U.S. Cl.
CPC ..... *F04B 43/043* (2013.01); *F04B 43/0081* (2013.01); *F04B 43/046* (2013.01);
(Continued)

(58) Field of Classification Search
CPC .. F04B 43/043; F04B 43/0081; F04B 43/046; F04B 49/065; F04B 49/20;
(Continued)

(56) References Cited

U.S. PATENT DOCUMENTS 6,104,127 A 8/2000 Kameyama et al.
6,848,631 B2 * 2/2005 Monson ..... F16J 3/02 239/102.1
(Continued)

FOREIGN PATENT DOCUMENTS

EP 1369585 A2 12/2003
EP 2957771 A1 12/2015
(Continued)

OTHER PUBLICATIONS

International Search Report and Written Opinion for PCT Application No. PCT/GB2022/051274; International Filing Date May 19, 2022, Date of Mailing Aug. 30, 2022; 13 pages.
(Continued)

*Primary Examiner* — Charles G Freay
(74) *Attorney, Agent, or Firm* — CANTOR COLBURN LLP

(57) ABSTRACT

A method for controlling a microfluidic pump having a pump body defining a cavity, and an actuator arranged to generate pressure oscillations of a fluid contained within the cavity in order to cause fluid flow through an inlet and an outlet of the cavity, the method comprising: oscillating the actuator at a first frequency and determining an indication of a peak velocity of the a peak velocity of the actuator at said first frequency; oscillating the actuator at a second frequency and determining an indication of a peak velocity of the actuator at said second frequency; and adjusting the fre-
(Continued)

quency of oscillation of the actuator to said first or second frequency for which the lowest peak velocity of the actuator was determined.

13 Claims, 16 Drawing Sheets

(51) Int. Cl.
*F04B 43/00* (2006.01)
*F04B 45/047* (2006.01)
*F04B 49/06* (2006.01)
*F04B 49/20* (2006.01)

(52) U.S. Cl.
CPC ..... *F04B 19/006* (2013.01); *F04B 45/047* (2013.01); *F04B 49/065* (2013.01); *F04B 49/20* (2013.01); *F04B 2203/0404* (2013.01); *F04B 2203/0409* (2013.01)

(58) Field of Classification Search
CPC ..... F04B 2203/0404; F04B 2203/0409; F04B 45/047; F04B 19/006
USPC ..... 417/413.1–413.3, 42
See application file for complete search history.

(56) References Cited

U.S. PATENT DOCUMENTS

| | | | | |
|---|---|---|---|---|
| 7,484,940 | B2 * | 2/2009 | O'Neill | F04B 43/043 417/413.1 |
| 2005/0219302 | A1 * | 10/2005 | Vogeley | F04B 43/046 347/19 |
| 2007/0273248 | A1 | 11/2007 | Wright | |
| 2008/0304979 | A1 | 12/2008 | Lucas | |
| 2013/0064683 | A1 * | 3/2013 | Oshima | F04B 43/046 417/63 |
| 2016/0258430 | A1 | 9/2016 | Merlen et al. | |

FOREIGN PATENT DOCUMENTS

| | | | | |
|---|---|---|---|---|
| GB | 2606743 | A * | 11/2022 | F04B 45/047 |
| WO | 2016111775 | A1 | 7/2016 | |

OTHER PUBLICATIONS

Search Report under Section 17 for International Application No. GB2107155.0, International Filing Date May 19, 2021, Date of Mailing Oct. 28, 2021; 1 page.

* cited by examiner

MICROFLUIDIC PUMP CONTROL

CROSS REFERENCE TO RELATED APPLICATIONS

This application is a National Stage filing of International Application No. PCT/GB2022/051274, filed on May 19, 2022, which claims the benefit of GB Patent Application No. 2107155.0, filed on May 19, 2021, both of which are incorporated by reference herein in their entireties.

TECHNICAL FIELD

The invention relates to microfluidic pumps and control methods for microfluidic pumps. In particular, the invention relates to oscillation-type pumps where pressure oscillations in a fluid cavity are induced in order to cause the fluid to flow through an inlet and an outlet of the cavity.

BACKGROUND

Oscillation-type pumps, such as the disc-shaped pump described in WO 2006/111775 A1, are driven by an actuator which oscillates at a chosen frequency in order to induce pressure oscillations in the fluid cavity. In WO 2006/111775 A1, the oscillation-type pump is operated in an acoustic resonance mode, in which the chosen frequency is a resonant frequency of the fluid in the cavity. This has the advantage of inducing amplified oscillations, which can produce a large flow rate through the pump.

In practice, determining the resonant frequency of the fluid in the cavity is challenging. Incorporating measurement equipment in the pump to determine the resonant frequency of the fluid in the cavity increases the cost and complexity of the design. Estimating this frequency as a fixed value typically leads to inefficient operation as the resonant frequency of the fluid in the cavity varies both part-to-part (due to construction variability), and during operation due to changes in pump temperature.

To meet this challenge, one approach described in WO 2020/070498 A1 is to instead choose a drive frequency where the electrical impedance of the pump is minimised. The pump is then designed such that resonant frequency of the fluid in the cavity is close to the frequency at which the electrical impedance of the pump is minimised, so that the drive frequency is approximately the resonant frequency of the fluid in the cavity.

However, during operation using the approach described in WO 2020/070498 A1 there may be a strong interaction between the actuator and the cavity. This interaction causes increased complexity in the frequency spectrum of the electrical impedance, with the ramification being that the frequency at which the electrical impedance is minimised is no longer such a good approximation to the resonant frequency of the fluid in the cavity. This, in turn, may lead to an increase in the motion of the actuator beyond acceptable levels, as the damping of the motion of the actuator is typically dominated by the action of the fluid in the cavity. Such motion can lead to unacceptable levels of stress within the components of the pump and reduce the lifetime of the pump. It is therefore desirable to provide an alternative way of controlling oscillation-type pumps, which decreases the stress on the components of the pump.

SUMMARY

According to a first aspect, the present disclosure provides a method for controlling a microfluidic pump having a pump body defining a cavity, and an actuator arranged to generate pressure oscillations of a fluid contained within the cavity in order to cause fluid flow through an inlet and an outlet of the cavity, the method comprising: oscillating the actuator at a first frequency and determining an indication of a peak velocity of the actuator at said first frequency; oscillating the actuator at a second frequency and determining an indication of a peak velocity of the actuator at said second frequency; and adjusting the frequency of oscillation of the actuator to said first or second frequency for which the lowest peak velocity of the actuator was determined.

By adjusting a frequency of oscillation of the actuator to reduce the peak velocity of the actuator, stress on the components of the pump can be reduced, and the lifetime of the pump can be improved.

In a first option, the microfluidic pump further comprises an electrical power supply for driving oscillation of the actuator, and the method comprises supplying a same power for driving oscillation of the actuator at the first frequency and at the second frequency when determining the peak velocity of the actuator.

In a second option, the microfluidic pump further comprises a sensor for measuring a pressure across the pump, and the method comprises producing a same pressure across the pump at the first frequency and at the second frequency when determining the peak velocity of the actuator.

By adjusting the frequency of oscillation of the actuator at fixed pump pressure to reduce the peak velocity of the actuator, stress on the actuator can be reduced while maintaining required pumping performance.

In a third option, oscillation of the actuator is driven by an electrical signal, and the indication of the peak velocity of the actuator is obtained using feedback from the actuator in the electrical signal.

By obtaining an indication of the peak velocity through feedback in the electrical signal, a driving circuit which controls the frequency of operation can be designed to use existing pump components. Additionally, for completely new pumps, the use of the feedback in the electrical signal simplifies the design.

In the third option, the electrical signal may comprise an oscillating voltage and an oscillating current, and the indication of the peak velocity of the actuator may be calculated using a phase difference between the oscillating voltage and the oscillating current.

By calculating the indication of the peak velocity using a phase difference, the indication of the peak velocity can be calculated without fully modelling the electrical behaviour of the actuator.

In the third option, the actuator may have an intrinsic capacitance, and the indication of the peak velocity of the actuator may be calculated using the intrinsic capacitance.

By calculating the indication of the peak velocity using the intrinsic capacitance, the indication of the peak velocity can be calculated without fully modelling the electrical behaviour of the actuator.

In a fourth option, the microfluidic pump further comprises an actuator motion sensor, and the peak velocity of the actuator is obtained using a signal from the actuator motion sensor.

In a fifth option, the adjusting of the frequency of oscillation of the actuator is repeated iteratively until the frequency of the actuator is a first drive frequency at which both increasing and decreasing the frequency of oscillation of the actuator increases the peak velocity of the actuator.

This iterative adjustment of the frequency further reduces the stress on the actuator.

In the fifth option, the method may further comprise: determining whether a characteristic of the electrical signal is in a required range at the drive frequency; and if the characteristic is not in the required range, adjusting the frequency of oscillation of the actuator further until the frequency of oscillation of the actuator is a second drive frequency, different from the first frequency, at which both increasing and decreasing the frequency of the actuator increases the peak velocity of the actuator.

This enhanced iterative adjustment of the frequency yet further reduces the stress on the actuator.

In a sixth option, the actuator is a piezoelectric actuator.

Piezoelectric actuators provide feedback through the piezoelectric effect and may provide a better response than alternatives such as solenoid actuators.

In a seventh option, the first frequency is a predetermined expected resonant frequency of the fluid in the cavity.

According to a second aspect, the present disclosure provides a microfluidic pump, comprising: a pump body defining a cavity, the cavity having an inlet and an outlet; an actuator arranged to generate pressure oscillations of a fluid contained within the cavity in order to cause fluid flow through the inlet and the outlet of the cavity; and a control circuit configured to perform a method according to the first aspect.

According to a third aspect, the present disclosure provides a storage medium storing processing instructions which, when executed by a control circuit of a microfluidic pump according to the second aspect, cause the control circuit to perform a method according to the first aspect.

BRIEF DESCRIPTION OF THE DRAWINGS

One or more aspects of the invention will now be described in more detail, purely by way of example, with reference to the accompanying drawings, in which.

DETAILED DESCRIPTION

Figure 1:
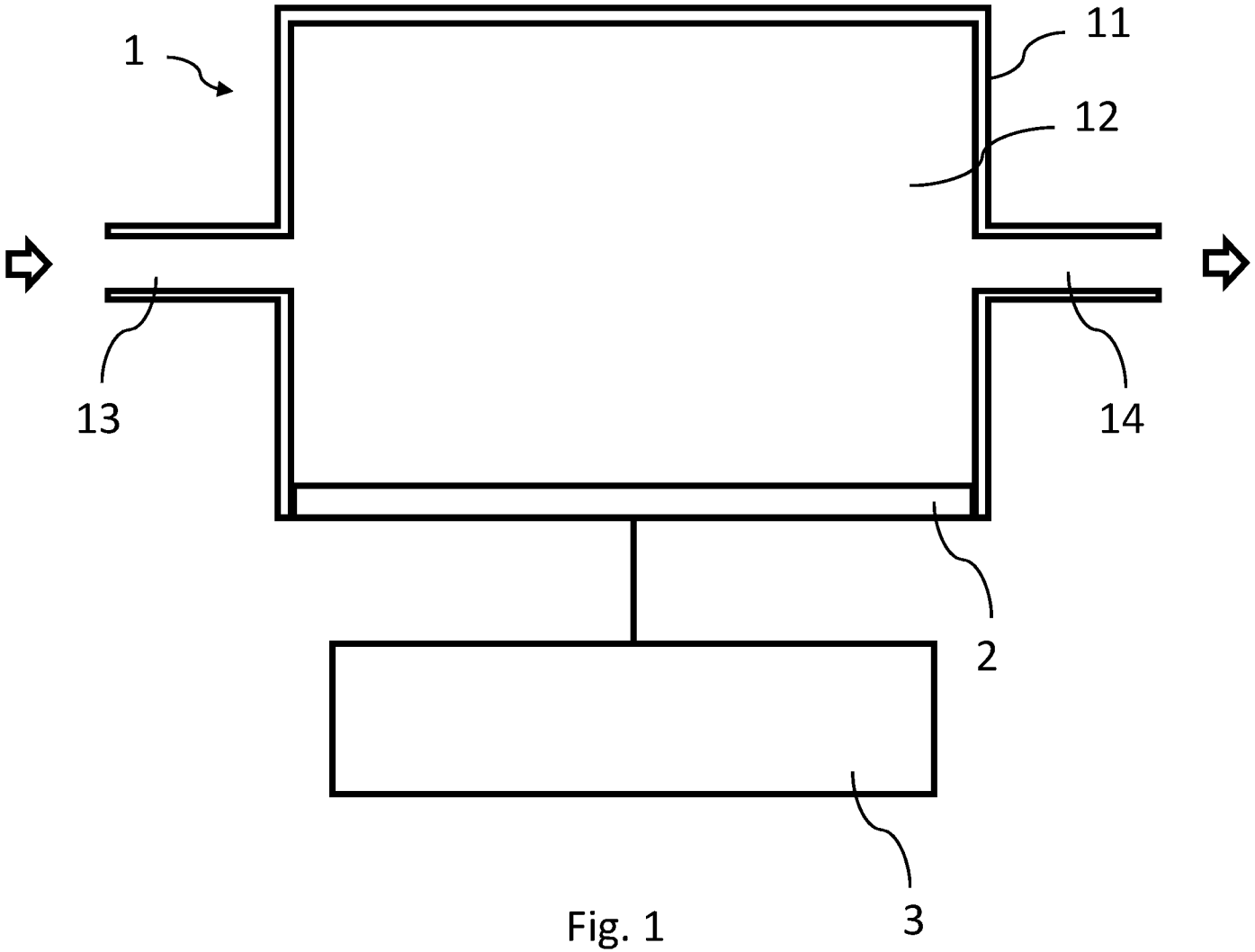
FIG. 1 is a schematic block diagram of a pump suitable for the invention.

FIG. 1 is a schematic block diagram of a pump suitable for the invention. The pump comprises a pump body 1 and an actuator 2. The actuator 2 is controlled by a control circuit 3.

The pump of FIG. 1 is a fluidic micropump which may pump liquid or gas. For example, the pump may be used to drive a precisely controlled volume of fluid, or may be used to provide a continuous pump pressure.

The pump body 1 contains a cavity 12 bounded by one or more walls 11. The actuator 2 drives fluid through the cavity 12 from one or more inlets 13 to one or more outlets 14. The actuator 2 may be arranged externally or internally to the cavity, driving oscillations through a wall 11 or driving oscillations through direct contact with the fluid in the cavity 12.

The oscillations preferably have a frequency greater than 5 kHz so that they are beyond the peak of human hearing sensitivity, and even more preferably greater than 20 kHz at which they cannot be heard. This means that the pump has a quiet or silent operation.

In some cases, the pump comprises more than one actuator 2. For example, two actuators may be arranged on opposing walls 11 on either side of the cavity 12.

In some cases, the pump body 1 contains more than one cavity 12. For example, the actuator 2 may be arranged to divide the internal volume of the pump body 2 into two cavities 12.

In order to increase the size of pressure oscillations in fluid, the pump is driven substantially at resonance, in a state where standing waves are established in the fluid, at a resonant frequency defined by the fluid and by the dimensions of the cavity 12.

The pressure oscillations in the fluid are rectified to provide directional flow. For example, this may be achieved by one or more valves, which may be located at the inlet 13 and/or outlet 14.

The actuator 2 is preferably a piezoelectric actuator which can be controlled electrically with high precision. More preferably, the actuator 2 may be a bending-mode piezoelectric actuator, so that the actuator can undergo oscillations with reduced stress within the piezoelectric material. Other types of actuator may nevertheless be used to drive oscillations in the fluid, such as a solenoid or a shape memory structure, or a non-mechanical drive such as temperature oscillations at a heater.

The actuator 2 may be designed to have a resonant frequency which is close to or equal to the resonant frequency of the fluid in the cavity 12, in order to improve efficiency. Conversely, the cavity 12 may be designed to have a resonant frequency which is close to or equal to the resonant frequency of the actuator.

Nevertheless, according to the described techniques, the actuator 2 may be driven at a frequency which is different from its resonant frequency. The actuator 2 will typically have a countably infinite number of higher-order resonant modes, with the resonant frequencies of those higher-order resonant modes typically being at non-integer multiples of the lowest resonant frequency. In general, when designing a pump, a certain resonant frequency of the actuator is chosen, and the pump geometry is chosen to optimise the performance close to that chosen resonant frequency. For example, the geometry of the pump may be chosen so that the pressure mode excited in the cavity or cavities are well spatially matched to the vibrational mode of the actuator. This ensures the efficient transfer of energy from the actuator into the cavity, as described in patent US 2011/0081267, which is hereby incorporated by reference. If a mode of the actuator is excited which is not the desired mode, the transfer of energy from the actuator to the pump cavity or cavities is typically less efficient and the performance of the pump may be reduced.

Figure 2A:
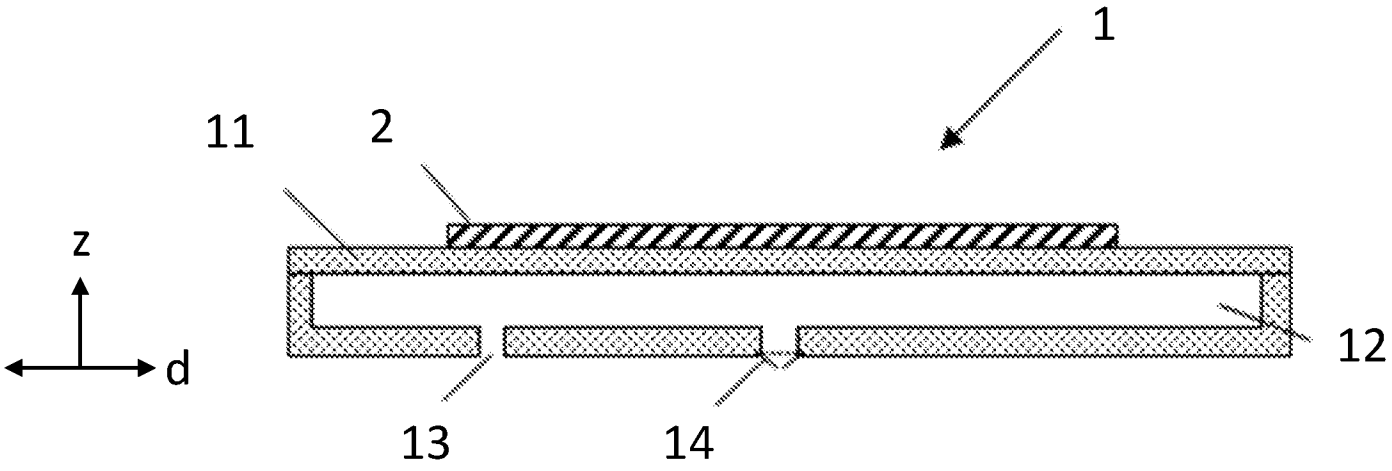
FIGS. 2A and 2B are schematic cross-sections of a specific pump suitable for the invention.
Figure 2B:
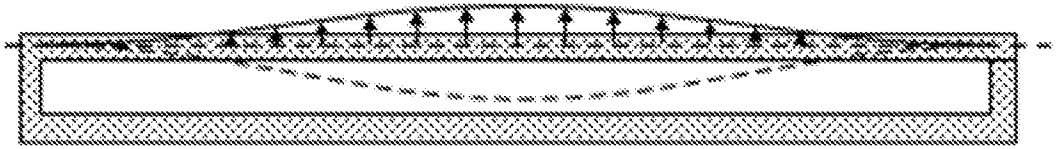

For example, the pump may be configured as shown in FIGS. 2A and 2B which are schematic cross-sections of a disc-shaped pump described in more detail in WO 2006/111775 A1. In this example, the cavity 12 has an approximately cylindrical shape (where the figures display a cross-section through the axis z and a diameter d). The axis z is short compared to the diameter d, giving a pseudo-disc shape, and resonant oscillations of the fluid can be described based on Bessel functions. In that configuration, fluid can be pumped efficiently from a radially outer inlet 13 to a radially central outlet 14.

Figure 3A:
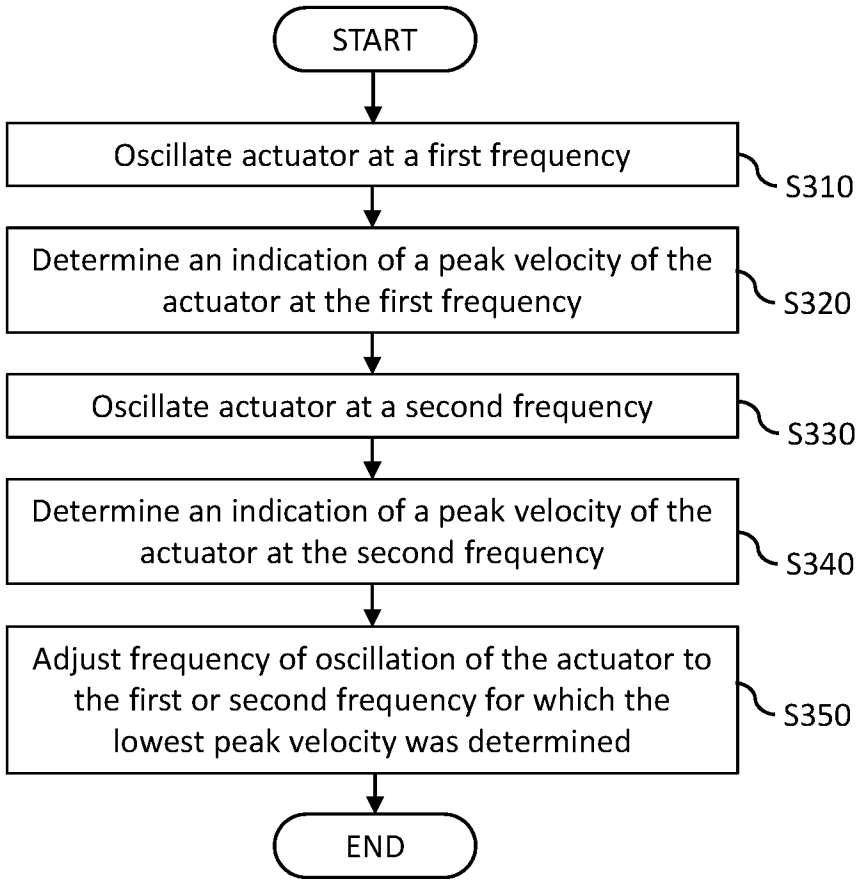
FIG. 3 is a flow chart schematically illustrating a method according to the invention.

FIG. 3A is a flow chart schematically illustrating a method of controlling a microfluidic pump. In particular, this method is used to select an oscillation frequency for the actuator 2. This method may be performed by the control circuit 3 in order to control the actuator.

At step S310, the actuator 2 is controlled to oscillate at a first frequency. For example, where the actuator 2 is a piezoelectric actuator, the actuator 2 is driven by an oscillating electrical signal at the first frequency.

At step S320, an indication of a peak velocity of the actuator 2 is determined while the actuator 2 is oscillating at the first frequency.

The velocity of the actuator 2 may be directly measured by an actuator motion sensor provided in the pump and connected to the control circuit 3. For example, the actuator motion sensor may be an optical sensor, a vibrometer, a touch sensor, or an acoustic noise sensor. The actuator motion sensor may be immediately adjacent to the actuator 2, or may sense motion indirectly through the pump 1.

However, preferably no separate component is required for determining the indication of the peak velocity, outside of the control circuit 3. As discussed in more detail below, an indication of the peak velocity of the actuator may instead be calculated using feedback in the electrical signal used to drive the actuator 2.

Equally, a portion of the actuator 2 may be configured as a sensing region which provides feedback in a sensing signal separate from the driving signal.

At steps S330 and S340, this process is repeated at a second frequency. Namely, at step S330, the actuator 2 is controlled to oscillate at a second frequency different from the first frequency. At step S340, an indication of a peak velocity of the actuator 2 is determined while the actuator 2 is oscillating at the second frequency.

At step S350, a selection is made between the first frequency and second frequency in order to reduce the peak velocity of the actuator 2. More specifically, a frequency of oscillation of the actuator is adjusted to whichever of the first and second frequencies for which the lowest peak velocity was determined.

The frequency selection in the method of FIG. 3A is typically subject to a required performance of the pump.

For example, the pump may be required to draw a fixed power from an electrical power supply provided with, or as part of, the pump (that is a fixed DC power time-averaged across oscillations). This may, for example, be required to match the capability of the electrical power supply, or to improve stability of the pump.

For a given actuator oscillation frequency, the fixed requirement can be achieved by additionally adjusting the amplitude or the waveform of the electrical signal. In a specific example, a fixed DC power may be controlled by adjusting an AC voltage amplitude or a time-averaged DC voltage for driving the actuator 2. In another alternative, the waveform may be adjusted by changing a phase difference between current and voltage, by adjusting a duty cycle of the electrical signal, or by performing pulse-width modulation on the signal driving the actuator 2. Furthermore, the electrical signal driving the actuator 2 may be varied among any set of suitable periodic functions, such as pure sine waves and square waves. The electrical signal driving the actuator 2 may be simply generated using any method, such as an inverter or an H-bridge, or may be additionally filtered or specifically generated to control its frequency spectrum.

While the amplitude and/or waveform is adjusted, the drawn power can be measured, for example using a current sensor and a voltage sensor, and the adjustment can continue until the required power is drawn. These optional additional steps are shown in FIG. 3B (steps S315 and S335).

In another example, the pump may be required to apply a fixed fluid pressure between the inlet 13 and the outlet 14. While the amplitude and/or waveform is adjusted, the applied pressure can be measured, for example using a current pressure sensor at the inlet 13 and a pressure sensor at the outlet 14, and the adjustment can continue until the required pressure is applied. These optional additional steps are shown in FIG. 3C (steps S317 and S337).

Many other performance requirements are possible, such as fixed DC current draw in the actuator, fixed DC voltage across the actuator, fixed actuator impedance, fixed phase difference between the oscillating voltage and oscillating current supplied to the actuator, fixed flow rate through the pump, and so on depending on the specific pump and power supply context for a given implementation.

Figure 3B:
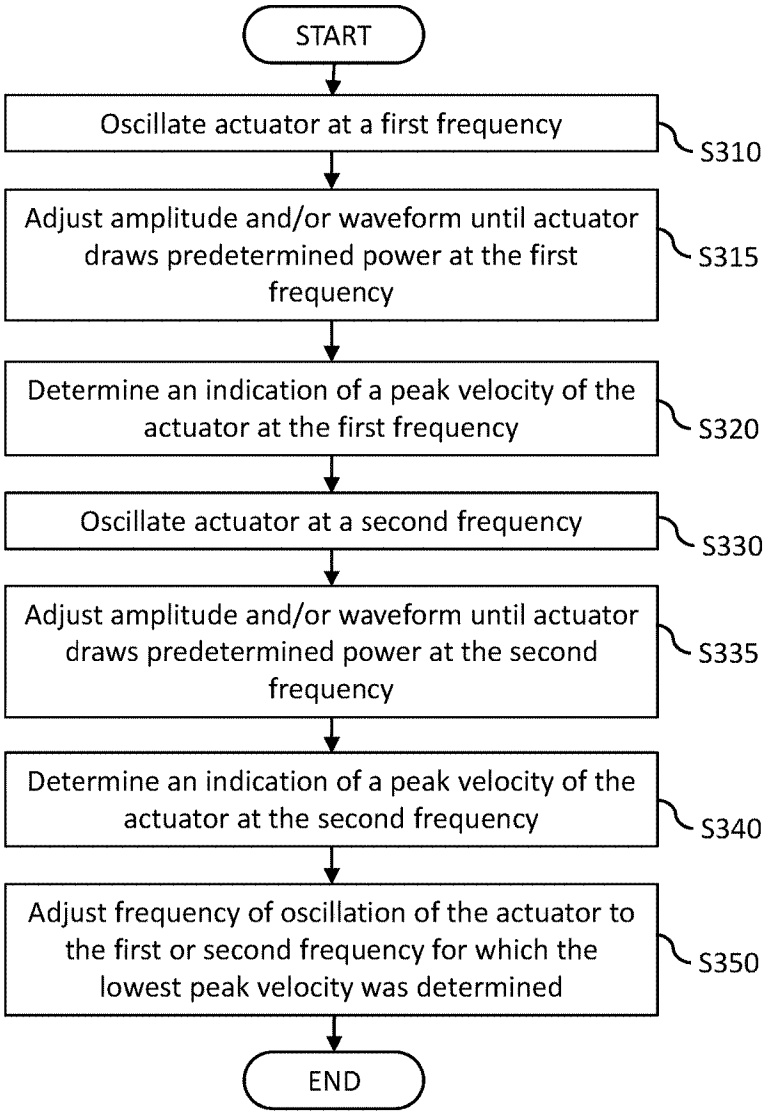
Figure 3C:
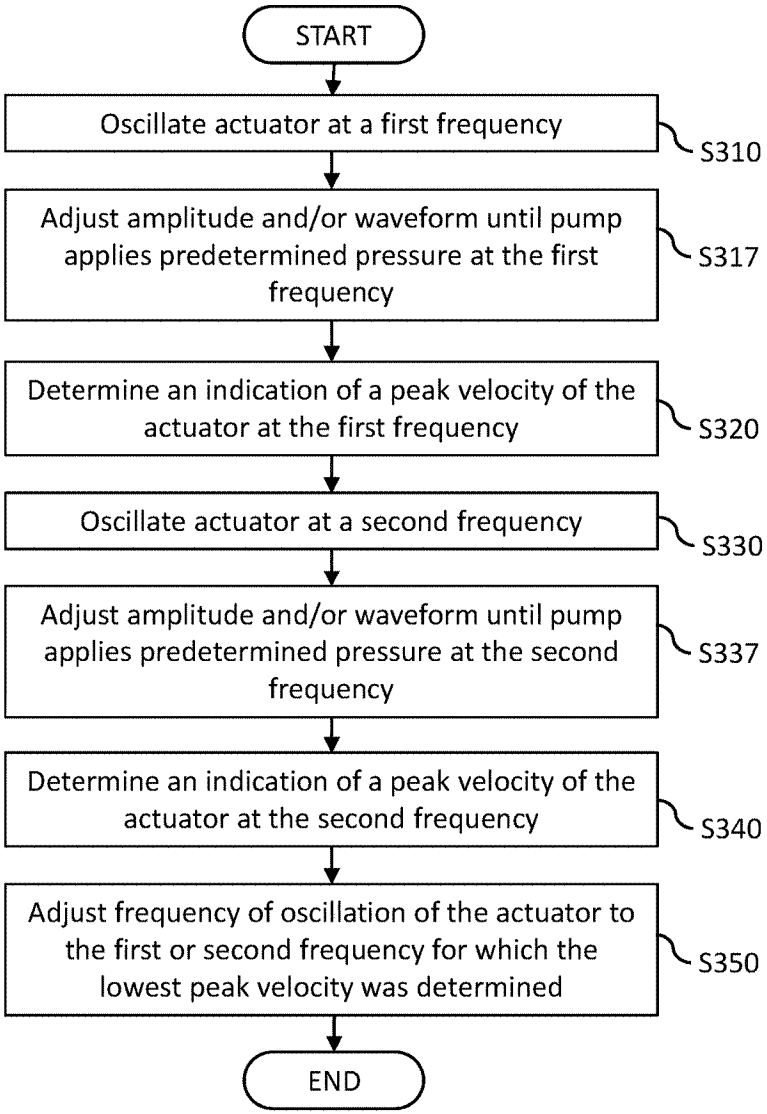

Frequency selection is not typically a binary selection between two frequencies, as in the simple example of FIGS. 3A to 3C. Instead, a drive frequency for driving the actuator 2 is chosen within a range of possible frequencies. The drive frequency may be determined in an iterative process as shown in of FIG. 4. More specifically, the adjusting step S350 of FIG. 3A may be repeated iteratively until a frequency of the actuator is a first drive frequency at which both increasing and decreasing the frequency of the actuator increases the peak velocity of the actuator, i.e. at a local or global minimum of the peak velocity of the actuator in the frequency spectrum.

Figure 4:
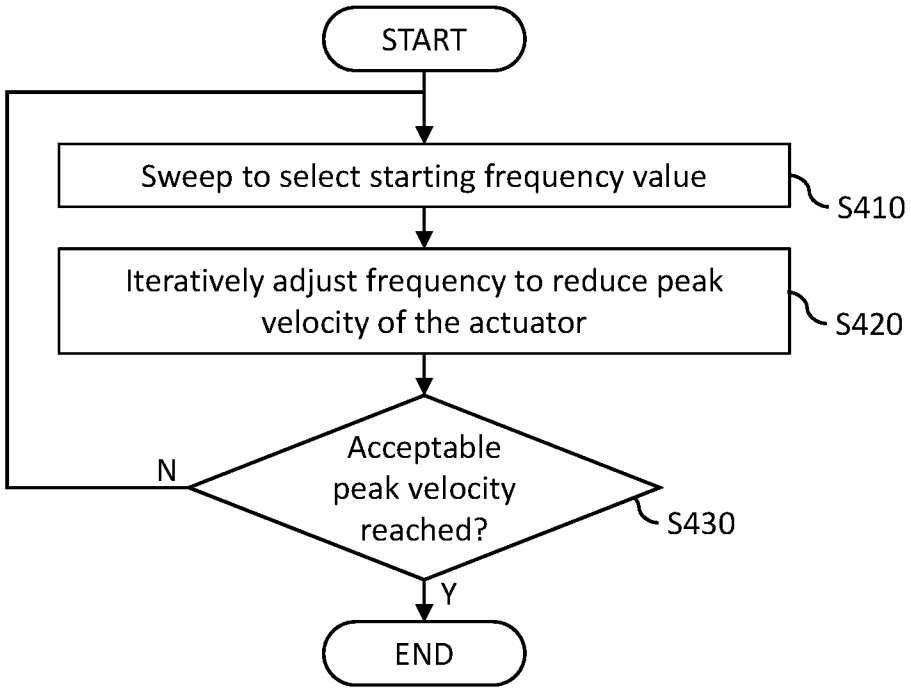
FIG. 4 is a flow chart schematically illustrating a further method according to the invention.

FIG. 4 is a flow chart schematically illustrating a further method of controlling a microfluidic pump. This method may again be performed by the control circuit 3 in order to control the actuator 2. The method may be performed as part of an initialisation by the control circuit 3.

Referring to FIG. 4, in step S410, the control circuit performs a sweep through a range of frequencies in order to identify a starting frequency value. As mentioned above, the operational frequency is preferably above 5 kHz to reduce audibility, and more preferably above 20 kHz so it cannot be heard. The range of frequencies used in step S410 may for example be centred on 21 kHz. For example, the range may be between 15 kHz and 27 kHz, or between 19 kHz and 23 kHz. The larger the frequency range, the longer the time required to perform step S410, and therefore it may be desirable to reduce the frequency range to avoid a long initialisation process for the pump. If a frequency response spectrum of peak velocity of the actuator is approximately known in advance, then a width of the range of frequencies is preferably chosen to be much larger than an expected frequency width of a trough around a minimum in the spectrum.

In one embodiment, step S410 is performed by applying a constant time-averaged voltage to the actuator and measuring the magnitude of the time-averaged current drawn by the actuator across the range of frequencies. The starting frequency value is identified as a frequency where the magnitude of the current is maximised. Alternatively, the starting frequency value may be the midpoint between two local minima of the current. The current may be measured as any of a complex value, a real component, an imaginary component or a magnitude.

In another embodiment, step S410 is performed by measuring a real electrical impedance of the actuator coupled to the pump across the range of frequencies, and identifying the starting frequency value as a frequency where the real electrical impedance is minimised. Instead of the real electrical impedance, the imaginary component or the magnitude of the electrical impedance could be used. Alternatively, the starting frequency value may be the midpoint between two local maxima of the electrical impedance.

Other local or global spectral points of interest may be used as a starting frequency value. For example, the amplitude of voltage across the actuator may be measured across the range of frequencies to identify maxima or minima.

Additionally, frequencies at which there is no phase difference between voltage and current in the electrical signal applied to the actuator may be identified.

In some embodiments, a sweep is not required and step S410 may be omitted. For example, a resonant frequency of the actuator 2 may be known in advance, and may be used as the starting frequency value. Alternatively, a resonant frequency of the cavity 12 filled with fluid may be estimated based on a speed of sound in the fluid and the dimensions of the walls 11, and this estimate may be used as the starting frequency value.

At step S420, the peak velocity of the actuator is iteratively decreased.

This is achieved by repeatedly performing the steps of FIG. 3A. In the first iteration, the first frequency used in steps S310, S320 and S350 is the starting frequency value selected in step S410, and the second frequency used in steps S330, S340 and S350 is a frequency near to the starting frequency value. In subsequent iterations, the first frequency is the adjusted frequency value resulting from the previous iteration of step S350, and the second frequency is a frequency near to the adjusted frequency value resulting from the previous iteration of step S350.

A difference (i.e. a step size) between the first frequency used in steps S310, S320 and S350 and the second frequency used in steps S330, S340 and S350 may be set such that few iterations are required to reach a minimum peak velocity. However, if the difference is too large, this may make convergence unreliable. The step size is preferably between 10 Hz and 1 kHz in order to balance these requirements. The step size may be predetermined at the manufacturing stage based on characteristics of the components of the pump body 1, actuator 2 and control circuit 3, and may be stored at a software or hardware level in the control circuit 3. The difference may also be dynamically chosen based on a local gradient of the indication of peak velocity against frequency, around the first frequency. Alternatively, the step size may simply be a fixed value.

A direction or size of frequency stepping in each iteration of step S420 may be chosen depending on the outcome of the previous iteration. If the outcome of the previous iteration was to maintain the same first frequency, because the peak velocity of the actuator indicated at the second frequency was higher than the peak velocity of the actuator indicated at the first frequency, then the direction of frequency stepping may be reversed or the size of frequency stepping may be reduced. On the other hand, if the outcome of the previous iteration was to adjust to a new second frequency, because the peak velocity of the actuator indicated at the second frequency was lower than the peak velocity of the actuator indicated at the first frequency, then the iterative process of step S420 may continue with the same direction and size of frequency stepping.

The iteration of step S420 may be repeated until a local or global minimum peak velocity of the actuator is found, or may be stopped when a criterion is met. For example, there may be a predetermined limit to the number of iterations, or there may be a predetermined acceptable peak velocity of the actuator at or below which iteration can stop.

At step S430, a logical check is made as to whether an acceptable peak velocity of the actuator 2 has been found by iteratively varying the frequency from the starting frequency value.

The logical check may comprise comparing the peak velocity of the actuator at the adjusted frequency value resulting from the last iteration of step S350 to a predetermined acceptable peak velocity.

Alternatively, step S430 may comprise determining whether any characteristic of the electrical signal driving the actuator, or a sensing signal obtained from the actuator, is in a required range at the adjusted frequency value resulting from the last iteration of step S350.

The required range(s) may for example be defined by any of capabilities of the control circuit, capabilities of components of the control circuit, the actuator or the pump body, safety considerations, indications of electrical short circuits. The method may comprise calculating capabilities of components which vary with age. For example, the control circuit 3 may include a timer to track the age of components since manufacture. As another example, the control circuit 3 may comprise a counter to track predicted fatigue of components based on use history of the pump, for example using a stress-life model such as Miner's rule.

The required range(s) may be set to be wide enough to allow for short term unacceptable pump performance so long as long term pump performance is acceptable, or vice versa to allow for long term unacceptable pump performance so long as short term pump performance is acceptable, depending on the specific usage.

In addition to using the logical check to detect whether the adjusted frequency is acceptable, the logical check may be used by the control circuit 3 to interrupt operation of the pump for safety or maintenance.

In one particular example, a required drive voltage may be determined at the adjusted frequency value as required to produce a predetermined fixed power. If the required drive voltage is too high, it may not be possible to actually run the pump at this voltage for an extended period. Similarly, if the required drive voltage is too low, then this may indicate that the pump will operate inefficiently or that there is an electrical short circuit in the actuator. In this example, the logical check may comprise a fail if the required drive voltage falls outside an acceptable range.

Additionally, in a case where the electrical signal driving the actuator 2 is controlled to include a mixture of multiple frequencies, the logical check may comprise checking the shape of the frequency spectrum or checking that specific frequencies are included or suppressed. For example, the actuator 2 may be driven with an approximate square wave, and the logical check may comprise checking that an undesirable harmonic has been suppressed.

As a further feature, step S430 may comprise a logical check of multiple iterations of step S350 performed in the iterative process of step S420. In particular, this may be used to check stability of the iterative algorithm in step S420. If the iterative algorithm is too unstable when starting from one starting frequency value, the logical check fails, and step S420 is repeated from a different starting frequency value. Additionally, consistent instability of step S420 may indicate that there is a problem with the actuator 2, such as cracking or delamination, and the logical check may be used to interrupt operation of the pump for safety or maintenance.

If the logical check of step S430 fails, then the method continues again at step S410 in which a new starting frequency value is selected.

In some embodiments, multiple candidate starting frequency values may be identified during step S410, at different local maxima, minima and turning points in a parameter measured across the frequency range, and/or at inferred potential maxima and minima midway between pairs of minima and maxima. In this case, the method can omit performing a further sweep when the result of step S430 is NO, and can instead immediately start step S420 from a new starting frequency value taken from the candidate starting frequency values.

In some embodiments, the method of FIG. 4 may also handle a case where no frequency associated with an acceptable peak velocity is found for any starting frequency value. This may trigger a change in pumping requirements, for example by reducing a fixed power drawn by the actuator or by reducing a fixed fluid pressure applied by the pump between the inlet 13 and the outlet 14.

The steps of FIG. 4 may be repeated periodically to follow any temporal variation of the actuator characteristics.

For example, the actuator coupled to the fluid cavity 12 may have different characteristics at different temperatures, and may undergo self-heating during continuous operation. Additionally, the characteristics of the actuator coupled to the fluid cavity 12 may change depending upon a load to which the pump is connected.

The steps of FIG. 4 may be repeated on a timer (such as between every 10 seconds and every hour, or preferably every 5 minutes), repeated at random intervals, and/or may be triggered by an event such as a change of ambient temperature or a sudden change in any internal electrical characteristic, any pumping characteristic such as the pressure between the inlet 13 and outlet 14, or any other performance characteristic such as a measured acoustic noise emitted by the pump. Here, a sudden change can mean a rate of change greater than a threshold, or a total change greater than a threshold since the last performance of the method of FIG. 4.

Additionally, step S420 may be repeated without performing the full method of FIG. 4, in order to track any changes in characteristics of the actuator 2 and the coupled pump cavity 12. Step S420 may be repeated on its own more frequently than the overall method of FIG. 4. For example, step S420 may be repeated between every 0.1 ms and every 1 ms, or more preferably between every 1 ms and every 20 ms.

Additionally, the iterative process of FIG. 4 or step S420 may comprise selecting a random frequency to use as the second frequency in steps S330, S340 and S350. For example, the iterative process may perform a random walk through different frequencies, or may use dithering. By adding a random component, the iterative process reach a frequency at which the peak velocity of the actuator is lower than by simple convergence, because the random variation may avoid local minima of the peak velocity which are higher than a global minimum.

Additionally, the fixed requirement adjustment steps S315, S335, S317, S337 may be performed more frequently than the frequency adjustment step S420. For example, the fixed requirement adjustment steps S315, S335, S317, S337 may be performed at least every 2 ms, while the frequency adjustment step S420 may be repeated every 10 ms. In general, the frequency adjustment steps and fixed requirement adjustment steps may be performed independently in any order.

Repeated changes to the frequency of operation of the actuator 2 can themselves have a detrimental effect on pump performance and stability of flow through the pump. Therefore, the difficulty (i.e. calculation time) of identifying an acceptable operation frequency may be used as a factor when deciding when to next perform the steps of FIG. 4. If adjustment takes only a small time, then the frequency may be adjusted often without affecting pump performance. On the other hand, if it took a long time before an adjusted frequency was found acceptable in step S430, then the adjusted frequency may be used for a long period before any adjustment of pump performance is repeated.

This reduction of the peak velocity of the actuator 2 according to the methods of FIGS. 3A to 3C and 4, as described above, goes against conventional wisdom, which states that the oscillation frequency of the actuator should be chosen to minimize actuator impedance, as this reduces the voltage needed to achieve a certain level of pneumatic output (i.e. pressure and/or flow) from the pump.

However, by reducing the peak velocity of the actuator 2, the inventors have identified that power dissipation in the actuator 2 is reduced and stress in the actuator 2 is reduced, meaning that a greater proportion of a supplied power is supplied as energy for fluid oscillations and simultaneously the lifetime of the actuator 2 can be improved.

Additionally, variation of actuator impedance by frequency is complex and difficult to predict, and can change dramatically across small frequency ranges, meaning that control schemes which track minimum actuator impedance can be chaotic and unstable, leading to similar unstable pump performance. On the other hand, the inventors have found that changes in actuator velocity with frequency depend more simply on the fluid and the dimensions of the cavity 12, meaning that a control scheme which tracks minimum actuator velocity is more stable.

Further to the methods of FIGS. 3A to 3C and 4, FIGS. 5 to 7 are used to explain techniques for modelling the characteristics of the pump, in order to more easily find a frequency at which the peak velocity of the actuator is reduced.

Figure 5:
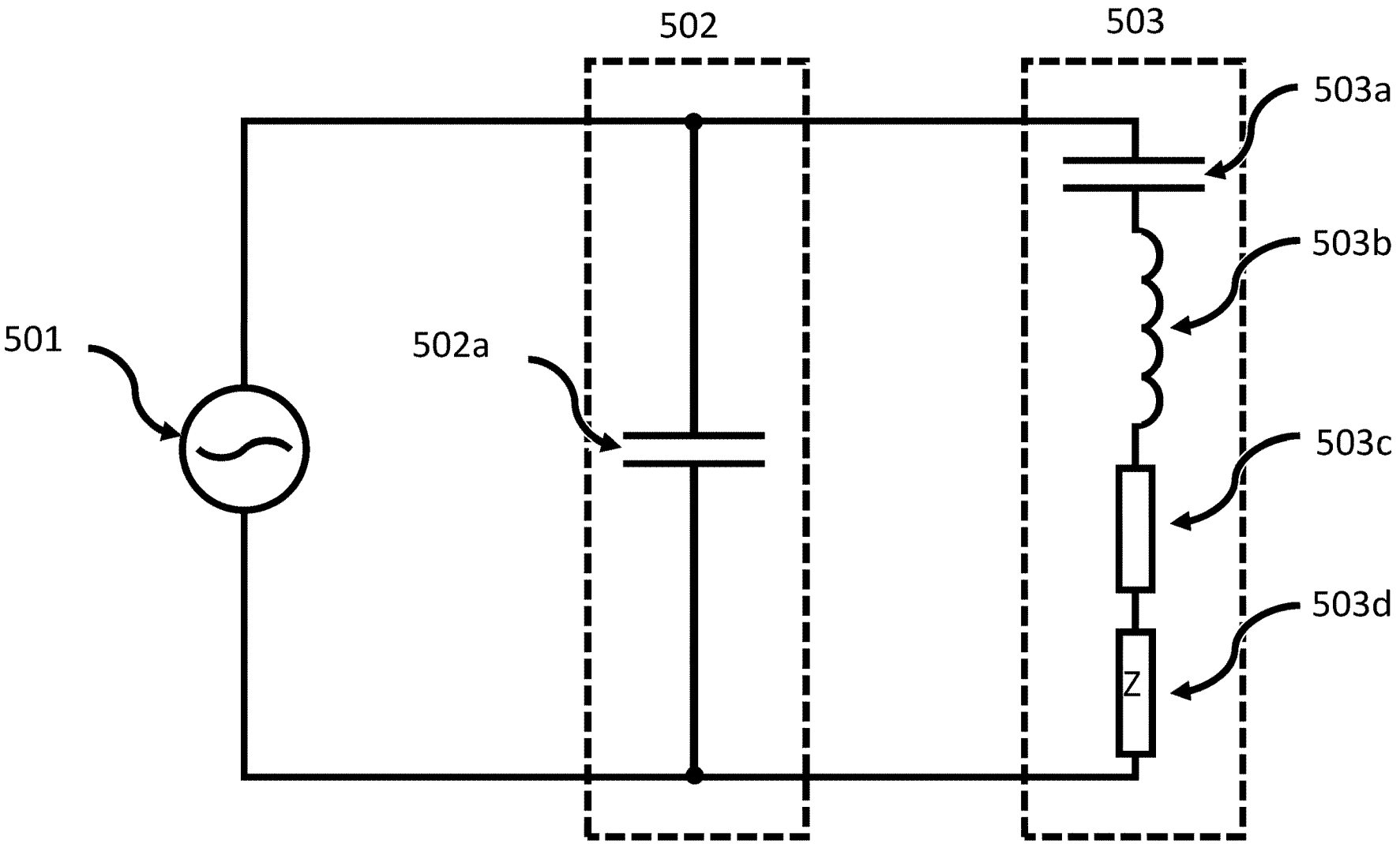
FIG. 5 is an example Butterworth Van Dyke equivalent circuit diagram for modelling impedance of an actuator oscillating fluid in a pump.

FIG. 5 is a Butterworth Van Dyke equivalent circuit diagram schematically illustrating the electrical impedance of the actuator 2 as it is driving the fluid in the pump body 1.

As shown in FIG. 5, when driven with an AC electrical signal 501, the impedance of the actuator 2 coupled to the pump body 1 may be modelled as two parallel branches 502 and 503.

The first branch 502 comprises a static or intrinsic capacitance $C_0$ of the actuator 2. In applications which require only low levels of accuracy, the intrinsic capacitance $C_0$ can be estimated. For example, in applications investigated by the inventors, the intrinsic capacitance $C_0$ was typically about 5 nF.

However, in more accurate applications, the intrinsic capacitance may be measured by the control circuit 3 before starting a pumping operation. The intrinsic capacitance may be measured at a frequency far from resonance (either a frequency much higher than the resonant frequency of the actuator 2 or a low frequency such as DC). For example, a DC signal, an oscillating signal having frequency lower than half of the resonant frequency of the actuator 2, or an oscillating signal having frequency greater than three times the resonance frequency of the actuator 2 may be applied to the actuator 2 in order to measure the intrinsic capacitance by measuring the impedance of the actuator. In these frequency ranges away from the resonant frequency of the actuator 2, the measurement may be expected to give an inaccuracy less than 2%. Other standard capacitance measuring techniques can be used, such as measuring charging or discharging time with a fixed current. In more complex methods, the intrinsic capacitance $C_0$ may be obtained by circuit simulation, by measuring the relative frequencies of motional resonance and antiresonance at higher resonance modes, or by calculating and compensating for the second branch impedance discussed below.

The intrinsic capacitance may be measured during pump operation. The measurement may be periodic, random, or in response to an external stimulus such as a change in pump or actuator temperature. Alternatively, the intrinsic capacitance can be set according to thermal measurements—for example, by means of a temperature sensor and a function or look-up table which is utilised by the control algorithm.

In some cases, a value of the intrinsic capacitance $C_0$ may be obtained at a manufacturing stage and stored as a value in the control circuit 3, in firmware or even hardware such as using a trimpot.

The second branch 503 models the dynamic response of the impedance of the actuator 2 when oscillating. This dynamic response means that the motion of the actuator 2 is indicated indirectly in feedback in the electrical signal 501. The second branch 503 comprises a capacitance 503*a*, an inductance 503*b*, and a resistance 503*c*, connected in series, to model a damped harmonic motion of the actuator.

Figure 6:
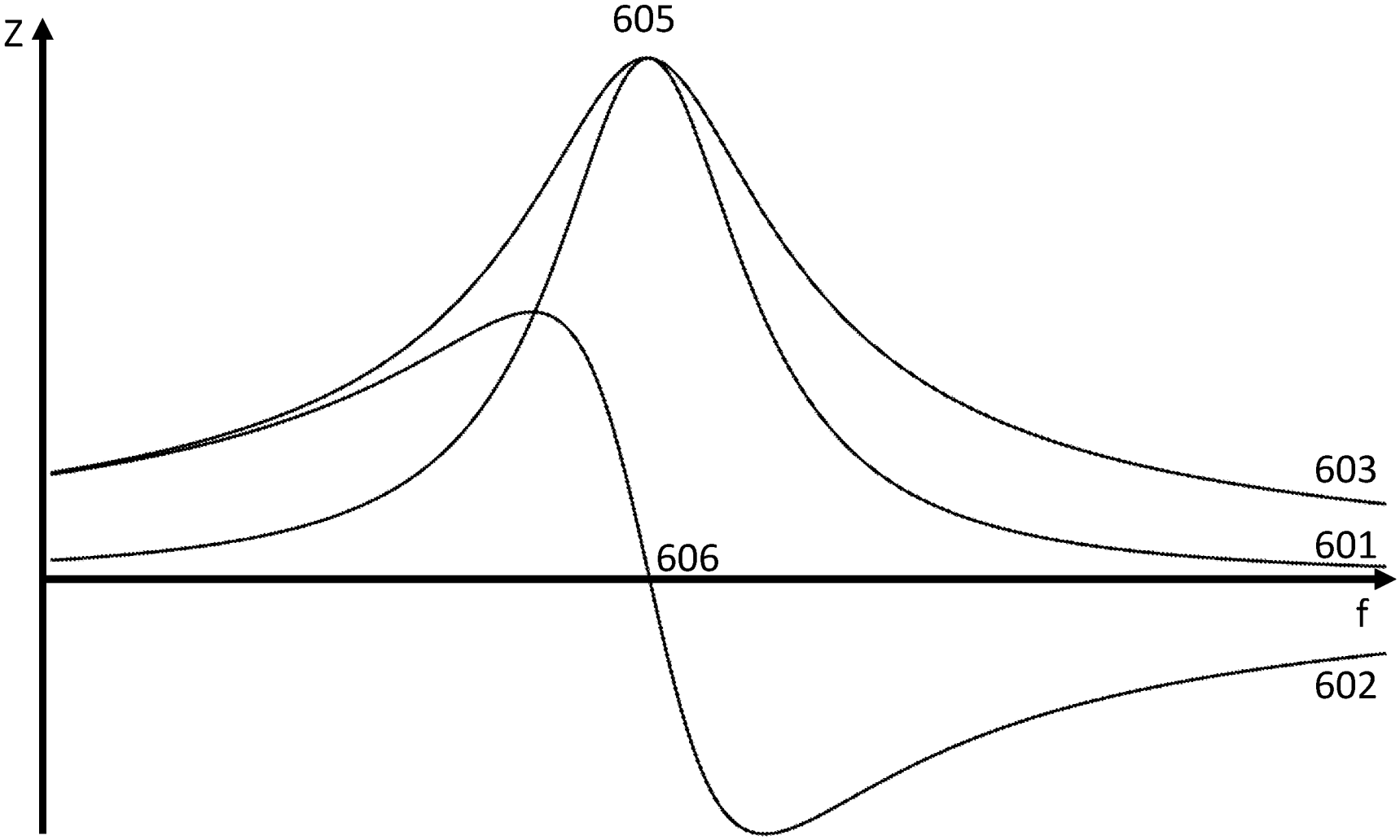
FIG. 6 is an example plot of impedance 503*d* in FIG. 5.

Additionally, the second branch 503 comprises a frequency-dependent complex impedance 503*d*, which models how the oscillation of the actuator 2 is coupled to and affected by the pressure oscillations in the fluid cavity 12. FIG. 6 shows a modelled example of the frequency-dependent complex impedance 503*d*. In FIG. 6, the impedance is shown as a real component 601, an imaginary component 602 and an overall magnitude 603. The real component 601 and magnitude 603 have a maximum 605 close to a resonant frequency of the cavity and tend toward zero away from the resonance. On the other hand, the imaginary component 602 has a zero 606 close to the resonant frequency of the cavity, and has a positive and a negative peak on either side of the resonant frequency.

Figure 7:
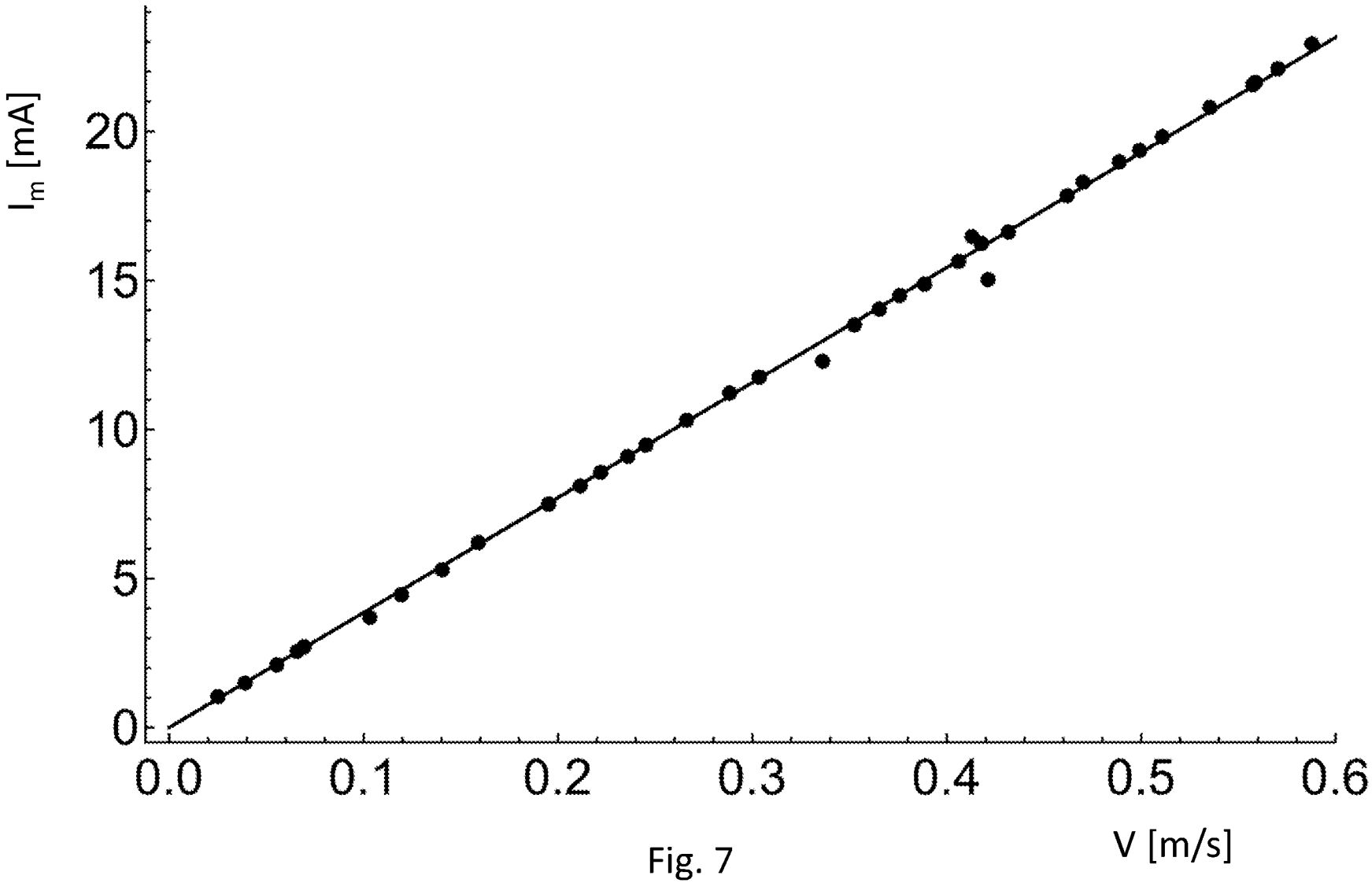
FIG. 7 is an example plot of calculated current against observed peak velocity of an actuator.

For the purposes of the method of the invention, a key point of this model is that the absolute value of the current $I_m$ through the second model branch 503 is proportional to the peak velocity V of the actuator 2 as shown in experimental data in FIG. 7. More specifically, FIG. 7 shows experimental measurements of actuator velocity V against values of absolute current $I_m$ calculated based on experimentally measured parameters of an actuator 2, when the actuator 2 was driven by electrical signals with different drive voltages. Thus, reducing the absolute current $I_m$ is equivalent to reducing the peak actuator velocity V.

In cases where the actuator 2 is a piezoelectric actuator, the assumption of an intrinsic capacitance $C_0$ in parallel with a dynamic branch 503 holds broadly. Where the actuator 2 is driven by an electrical signal having oscillating voltage $V_0e^{i2\pi ft}e^{i\phi}$ and oscillating current $I_0e^{i2\pi ft}$ where the voltage leads the current with a phase offset of $\phi$, it can be shown using Ohm's law and parallel impedance that the impedance of the dynamic branch is:

$$Z_m = \left(\frac{I_0}{V_0}e^{-i\phi} - i2\pi fC_0\right)^{-1}$$

The absolute value of this impedance is $$|Z_m| = \frac{1}{\sqrt{\left(\frac{I_0}{V_0}\cos(\phi)\right)^2 + \left(\frac{I_0}{V_0}\sin(\phi) + 2\pi fC_0\right)^2}}$$

Thus, the absolute current $I_m$ through the dynamic branch 503 is calculated according to Equation 1:

$$I_m = \frac{V_0}{|Z_m|} = \sqrt{(I_0\cos(\phi))^2 + (I_0\sin(\phi) + 2\pi fV_0C_0)^2} \quad (1)$$

This means that a value indicative of the peak velocity of the actuator can be calculated so long as the drive voltage $V_0$, drive current $I_0$, frequency f, phase offset $\phi$ and intrinsic capacitance $C_0$ are known. The frequency f and voltage $V_0$ are typically parameters controlled by the control circuit 3, the drive current $I_0$ can be determined using a sense resistor, and phase offset $\phi$ can be determined from the driving waveform and measured current.

Therefore, steps S320 and S340 as described above can be performed using measurements within the control circuit 3, based on feedback in the electrical signal driving the actuator.

Other related parameters may equivalently be used as an analogue for the peak velocity, when determining an indication of a peak velocity in steps S320 and S340. For example, the real impedance of the dynamic branch 503 is calculated according to Equation 2:

$$\mathrm{Re}(Z_m) = \frac{a\Pi}{(I_0\cos(\phi))^2 + (I_0\sin(\phi) + 2\pi fV_0C_0)^2} \quad (2)$$

where a is a constant representing the drive waveform, and $\Pi$ is the real power drawn by the actuator 2. This real impedance is maximised when the absolute current $I_m$ is minimised, and thus provides an inverse indication of peak velocity of the actuator which should be maximised in order to reduce the peak velocity of the actuator.

Furthermore, the absolute current $I_m$ or real impedance of the dynamic branch 503 may be determined by other methods such as characterization, for example by identifying relative positions of resonances and antiresonances, or curve fitting to determine the values of the modelled components. These techniques may be performed either at the manufacturing stage or during normal operation controlled by the control circuit 3.

However, it is desirable that the method of determining an indication of the peak velocity of the actuator 2 in steps S320 and S340 is not overly complex, as this may need to be calculated regularly to maintain a reduced peak velocity under changing conditions. As one way of reducing calculation time, a function Q of the parameter obtained in Equation 1 or Equation 2, $Q(I_m)$ or $Q(Re(Z_m))$, or another related parameter, may be used as follows:

The above described calculated parameters are used to identify minima or maxima, that is, frequencies at which their derivative with respect to frequency is zero.

Due to the chain rule, zeroes in the frequency derivative of $I_m$ or $Re(Z_m)$ are also zeroes in the frequency derivative of $Q(I_m)$ or $Q(Re(Z_m))$, so long as their derivatives with respect to $I_m$ and $Re(Z_m)$ are non-zero for other frequencies in the relevant frequency range.

Therefore suitable Q functions such as $Q(I_m)=1\ m^2$ and $Q(Re(Z_m))=\sqrt{Re(Z_m)}$ may be used instead of $I_m$ or $Re(Z_m)$ in steps S320 and S340. For example, by using $Q(I_m)=I_m^2$, the need for a square root calculation in Equation 1 above is eliminated, saving computation time. On the other hand, by using $Q(Re(Z_m))=\sqrt{Re(Z_m)}$, a Fast Inverse Square Root algorithm can be used to calculate an accurate approximation of $Re(Z_m)$ with reduced computation time.

As a further refinement of the above described calculations for $I_m$ or $Re(Z_m)$ or related parameters used in step S320 and S340, smoothing over a suitable frequency range or time interval may be used to reduce noise in a calculated parameter. Such smoothing may be performed in combination with, and before or after, applying a function Q to the parameter.

The above description assumes that the Q function is both continuous and differentiable in the relevant frequency range. Alternative choices of Q function which are not continuous and/or not differentiable at frequencies within the relevant frequency range can also be used with this method. In this case, zeroes in the frequency derivative of $I_m$ or $Re(Z_m)$ are also critical points of $Q(I_m)$ or $Q(Re(Z_m))$ with respect to frequency. As above, this holds so long as there are no critical points of $Q(I_m)$ or $Q(Re(Z_m))$ with respect to $I_m$ and $Re(Z_m)$ for other frequencies in the relevant frequency range.

Of course, the equivalent circuit diagram will be different from FIG. 5 for different configurations of the actuator 2 and the pump body 1. For example, an actuator 2 and coupled pump body 1 having multiple resonances could be modelled using a parallel branch 503 for each resonance. The electrical signal may drive oscillations at or near any combination of one or more of the multiple resonances. However, the above calculations are not dependent upon the specific configuration of the actuator 2 and the pump body 1, and thus the voltage, current, and phase difference of the electrical signal can be used with the intrinsic capacitance for calculations at each oscillation frequency.

Control circuit 3 can be any control circuit capable of generating an electrical signal for driving the actuator 2 at different frequencies, and capable of receiving one or more sensor inputs which can be used to indicate peak velocity of the actuator 2, as well as implementing any of the above described methods in software or hardware.

Figure 8:
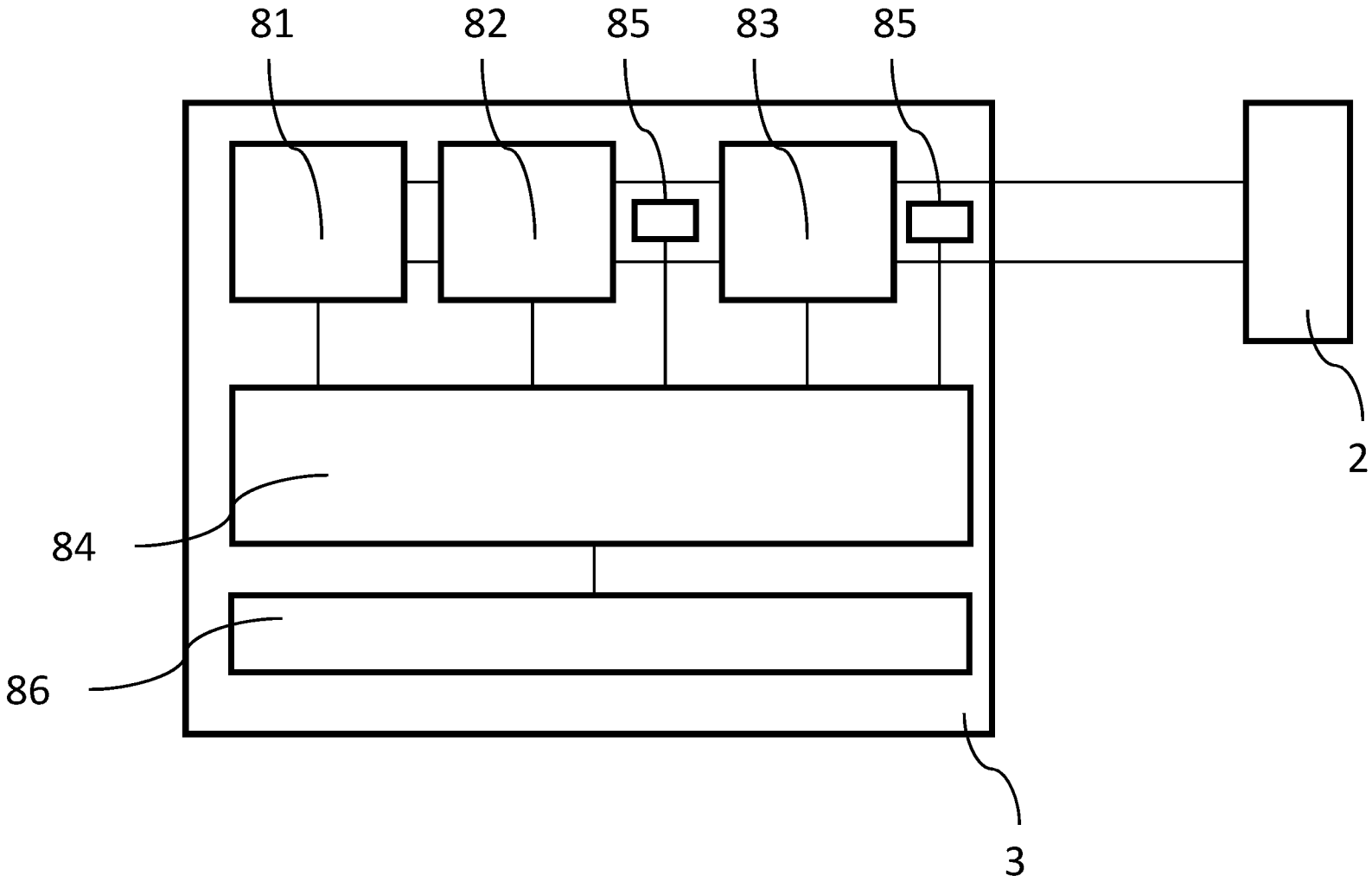
FIG. 8 is a schematic block diagram illustrating components of the control circuit 3.

FIG. 8 is a schematic block diagram illustrating components of an example control circuit 3.

In this example, the control circuit 3 has a drive signal generating train comprising a DC power supply 81, a boost converter 82 and a DC-AC converter 83. The DC power supply 81 may for example comprise a battery or a mains power supply.

The boost converter 82 may be replaced with any kind of voltage converter.

The DC-AC converter 83 typically comprises an H-bridge but may instead comprise an inverter such as a transformer or an electromechanical or semiconductor-based circuit.

More generally, the DC-AC converter 83 can be of any kind suitable for driving the actuator 2 at a required velocity and frequency for the good operation of the pump. As the method described herein selects a drive frequency which is close to the resonant frequency of the cavity or cavities in the pump, the circuit may be required to drive at frequencies different from the resonant frequency of the actuator 2. This can increase the voltage required to drive the actuator 2 at the desired velocity. Thus, it may be beneficial for the DC-AC converter 83 to amplify the drive voltage—for example, by making use of an H-bridge, or a power amplifier of suitable class.

Driving the actuator 2 at higher voltages may increase the resistive losses within the DC-AC converter 83; such losses typically scale proportionally to the square of the magnitude of the drive voltage. Different types of DC-AC converters 83 are more or less susceptible to this type of loss.

The boost converter 82 and DC-AC converter 83 are controlled by a processor 84 in order to control the magnitude and frequency of an AC voltage supplied from the control circuit 3 to the actuator 2.

The control circuit 3 additionally comprises one or more internal sensors 85 for measuring a current magnitude and a phase difference between the AC voltage and AC current supplied from the control circuit 3 to the actuator 2. These can be used by the processor 84 as described above in order to determine an indication of peak velocity of the actuator 2.

Any of the methods and calculations described above may be defined as computer program instructions to be executed by a processor 84 in the control circuit 3. The computer program instructions may be stored in a memory 86 of the control circuit 3.

Additionally, the computer program instructions may be stored in a computer-readable storage medium, or may be defined as data in a signal. In this way, the control circuit 3 may, after manufacturing, be configured according to the invention by installing the computer program instructions in the memory 86.

The method described above may be further refined by incorporation of elements from the control circuit into the Butterworth Van Dyke model of the pump system. For example, a contact resistance could be incorporated as resistor in series with the AC electric signal 501. If an H-bridge is used to provide the AC electric signal, this too could be incorporated. So long as an expression may be found for the absolute current $I_m$ through the dynamic branch 503, the methods described herein can be applied. This is particularly useful if, for practical circuit design reasons, any measurement or sensing elements of the control circuit 3 are distant from the pump on the circuit board.

In the above-described methods, a frequency of oscillation of the actuator 2 is adjusted in order to reduce the peak velocity of the actuator. However, the frequency of oscillation may instead be optimised for other goals.

Figure 9:
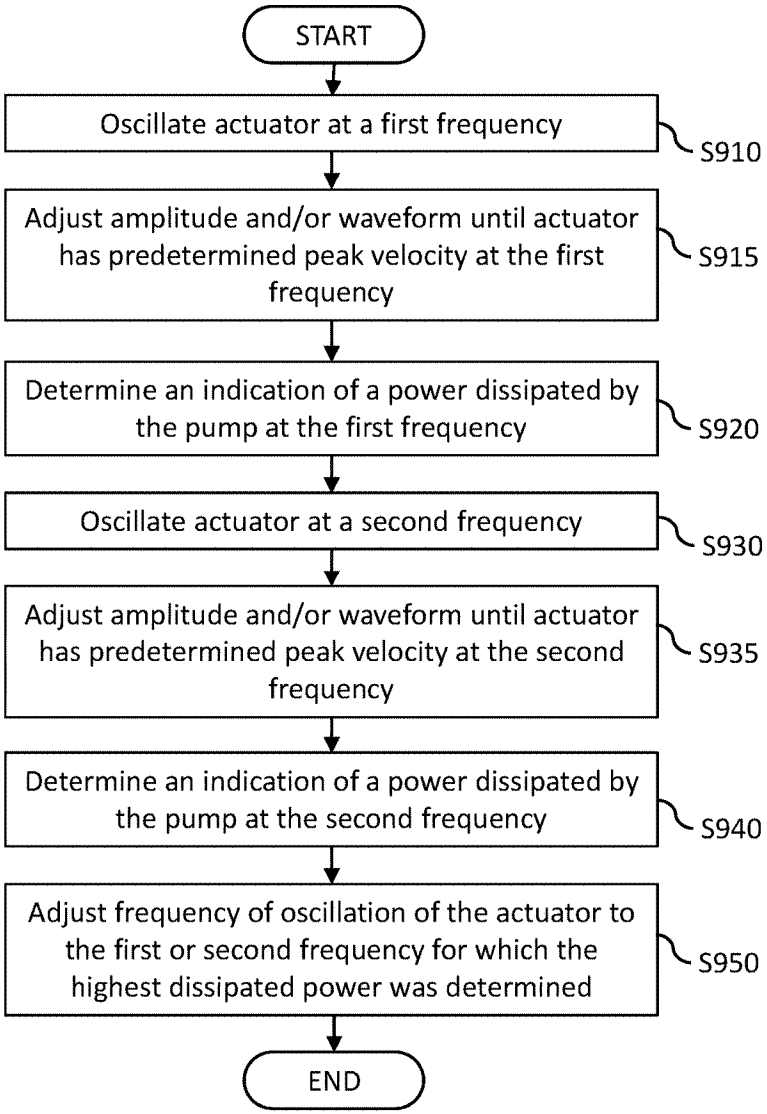
FIG. 9 is a flow chart schematically illustrating another pump control method related to the invention.

For example, FIG. 9 is a flow chart schematically illustrating another pump control method related to the invention. In FIG. 9, the peak velocity of the actuator is a fixed parameter which is achieved at each of a first and second frequency, and the frequency is adjusted to the first frequency or the second frequency depending on which gives the highest dissipated power in the pump. This alternative control method means that the pneumatic stability of the pump can be improved, while the power delivered to the pump to drive fluid is maximised.

The steps of FIG. 9 are similar to the steps of FIG. 3B, and may be implemented using similar techniques to those described above. More specifically, both FIG. 3B and FIG. 9 require oscillating the actuator at a first frequency and a second frequency (steps S910 and S930) and measuring dissipated power and peak velocity of the actuator. However, in FIG. 9, the dissipated power is allowed to vary (as determined in steps S920 and S940, and as the frequency is adjusted in step S950), while the voltage and/or waveform are adjusted to maintain a fixed peak velocity of the actuator (in steps S915 and S935).

In the method of FIG. 9, the dissipated power may be determined similarly to the above described techniques for determining peak velocity. More specifically, it can be shown that the dissipated power Π is related to $I_m$ and $Re(Z_m)$ as follows in Equation 3:

$$I_m^2 \propto \frac{\Pi}{\mathrm{Re}(z_m)} \tag{3}$$

As a result, by maintaining constant current $I_m$ (and therefore constant peak velocity of the actuator) while maximising impedance $Re(Z_m)$, the dissipated power Π is also maximised.

A suitable starting frequency value for maximising dissipated power at constant current $I_m$ can be found by performing a sweep to find maxima of the magnitude of the drive voltage. This voltage is equal to the product of the current $I_m$ and the absolute value of the impedance $Z_m$: $|V|=I_m|Z_m|$ and therefore calculations similar to those described above can again be used for this sweep.

Since the techniques for this method are similar to techniques which can be used for minimizing peak velocity of the actuator, a single control circuit can be efficiently configured with a first mode of minimizing peak velocity of the actuator and a second mode of maximising the dissipated power.

In another example method, instead of maximising the power, the pressure across the pump between the inlet 13 and outlet 14 may be maximised. This pressure may be expected to be substantially proportional to the cavity impedance 503*d* in the model described above with reference to FIG. 5. Therefore, the pressure can be calculated using the model of FIG. 5.

More specifically, pre-characterization of the actuator 2 before addition of the pump body 1 may be used to determine the parameters of the model of FIG. 5 other than the cavity impedance 503*d*. These parameters can be stored in the control circuit 3 and used together with electrical measurements at different frequencies to calculate or curve fit the cavity impedance 503*d*.

Alternatively, curve fitting at different frequencies may be used to determine all parameters of the model of FIG. 5 in operation. In particular, the pump may be driven at frequencies far from resonance, where the pump cavity does not respond to or damp oscillation of the actuator, in order to calculate or curve fit the parameters of the model of FIG. 5 other than the cavity impedance 503*d*. Then, further calculation or curve fitting close to resonance can be used to determine the cavity impedance 503*d*.

In another example method, the frequency of oscillation may be optimised to minimise the phase angle between the oscillating voltage and oscillating current of the electrical signal used to drive the actuator, while a magnitude of the current through the dynamic branch 503 drawn by the actuator (as calculated in Equation 1 above) is maintained at a fixed value. An optimisation criterion for this method may be defined by a hardware loop satisfying the Barkhausen oscillation condition.

The inventors note that the frequency-dependent complex impedance 503*d* causes a change in the electrical phase close to the resonant frequency of pressure oscillations in the fluid cavity. When the resonant frequency of the actuator is sufficiently detuned from the resonant frequency of the fluid in the pump cavity, this manifests as a measurable increase in the electrical phase close to the resonant frequency of pressure oscillations in the fluid cavity, and therefore close to the lowest attainable peak velocity of the actuator. Therefore, this phenomenon may optionally be used to determine an approximate indication of the peak velocity at any step in the method described here. In an example method that uses this phenomenon, the frequency of oscillation may be optimised such that the phase angle between the oscillating voltage and oscillating current of the electrical signal used to drive the actuator reaches a locally maximal value.

Conversely, when the resonant frequency of the actuator is sufficiently close to the resonant frequency of the fluid in the pump cavity, this phenomenon manifests as an increase in the complexity of the electrical phase. This typically consists of the following features: at least two maxima (one of which may be the global maximum) and at least one local minimum in the electrical phase. Any of these features may optionally be used to determine an approximate indication of the peak velocity at any step in the method described here. It will be clear to one skilled in the art that, at any given instant, one of the features will be more suitable than the others as an indicator of the peak velocity of the actuator; therefore, a method of selection should be employed in order to choose which of the features to use. More generally, a critical point in the frequency spectrum of the electrical phase, or a critical point in some function Q(ϕ) of the electrical phase may be used to determine the drive frequency using any of the methods described herein.

In general, a class of control methods provided by the above-described techniques may be summarised as:

1. Oscillate the actuator 2 at a first frequency;
2. Adjust one or more control parameters of the electrical drive signal until a first dynamic characteristic of the pump is within a predetermined range at the first frequency;
3. Obtain an indication of a second dynamic characteristic of the pump at the first frequency;
4. Oscillate the actuator 2 at a second frequency;
5. Adjust one or more control parameters of the electrical drive signal until the first dynamic characteristic of the pump is within a predetermined range at the second frequency;
6. Obtain an indication of the second dynamic characteristic of the pump at the second frequency;
7. Select the first frequency or the second frequency based on a comparison of the second dynamic characteristic at the first frequency and at the second frequency, and based on an optimisation strategy for the second dynamic characteristic.

Additionally, the above-described methods include processing of the electrical signal that drives the actuator in ways which have other applications. In particular, the current calculated using Equation 1 and the impedance calculated using Equation 2 can be used for monitoring other behaviour of the pump, separate from adjusting the frequency.

In particular, the current $I_m$ calculated in Equation 1 can be used to determine a stress history of the actuator within the pump, estimate the remaining product lifetime, diagnose product issues, or to prevent improper operation via a watchdog protocol or similar. For example, a chosen frequency for the electrical signal driving the actuator may be verified using a logical test on the current $I_m$. For example, if $I_m$ exceeds a reference value, the actuator peak velocity will be high and therefore the alternating stresses experienced by the internal pump components will also be high. Conversely, if $I_m$ is below a reference value, the presence of an electrical or mechanical failure of an internal pump component can be inferred. Another example logical test uses gradated limits to allow intermittent drive at values of $I_m$ above those deemed acceptable for long term use, whilst still below values deemed unacceptable even for short term use where (for example) the likelihood of cracking or delamination of a piezoelectric element of the actuator is deemed unacceptably high. The limits chosen may be static values or may evolve during operation depending on historical values of $I_m$. In one example, the maximum allowed value of $I_m$ is calculated during operation based on measured, historical values of the drive voltage magnitude, $I_m$, or other signals related to the stresses experienced by pump components, in conjunction with a suitable stress-life model (e.g. Miner's rule or otherwise).

Additionally, as the frequency at which $I_m$ is minimised (or, equivalently, at which $Re(Z_m)$ is maximised or $Im(Z_m)$ is zero) is determined by the resonance of the fluid cavity or cavities within the pump, this frequency can be used to calculate characteristics of the fluid within the acoustic cavity during operation. Of particular interest in some applications are the pump temperature and the fluid composition within the cavity or cavities, both of which may be calculated from the value and history of the frequency at which $I_m$ is minimised.

Additionally, as mentioned above, it is possible to calculate the pressure in the cavity 12 using the model of FIG. 5. This pressure can be used for diagnosis and monitoring of the health of the pump during operation.

Figure 10:
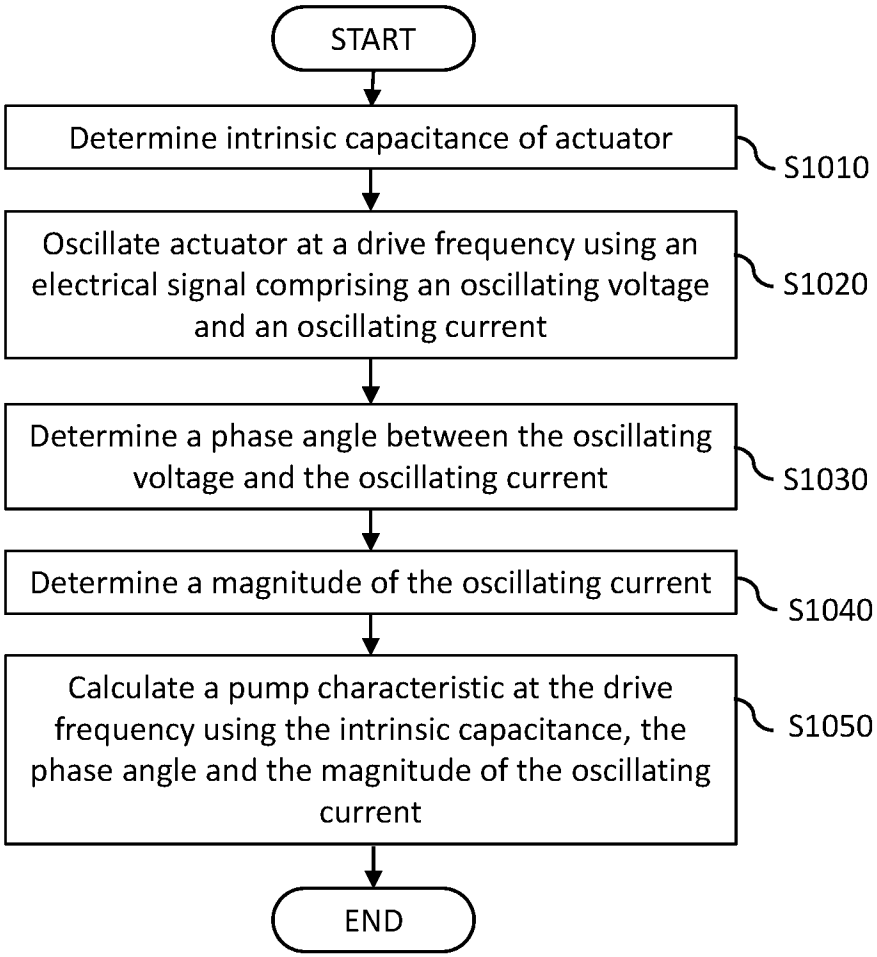
FIG. 10 is a flow chart schematically illustrating alternative uses of electrical signal feedback related to the invention.

FIG. 10 is a flow chart schematically illustrating alternative uses of electrical signal feedback related to the invention, as provided by the above-described techniques.

At step S1010, an intrinsic capacitance of the actuator 2 is determined. The intrinsic capacitance may be determined using any of the above described techniques, such as measuring the impedance of the actuator 2 at a frequency far from a resonant frequency of the actuator 2.

At step S1020, the actuator 2 is driven to oscillate at a drive frequency using an electrical signal comprising an oscillating voltage and an oscillating current. The drive frequency is typically a frequency at which the pump can effectively operate, that is, a frequency at or near to a resonant frequency of the actuator 2 and at or near to a resonant frequency of the pump body 1 containing a given fluid.

At step S1030, a phase angle $ between the oscillating voltage and the oscillating current is determined. This may be determined by measuring the oscillating current over time and comparing the oscillating current to a controlled oscillating voltage output from the control circuit 3 to the actuator 2.

At step S1040, a magnitude |I| of the current output from the control circuit 3 to the actuator 2 is determined. This may also be determined by measuring the oscillating current.

At step S1050, a characteristic of the pump is determined at the drive frequency using the previously-determined intrinsic capacitance, phase angle and magnitude of the oscillating current. For example, the characteristic may be any of the parameters $I_m$, $Z_m$, |V|, or Π as discussed above, or any other parameter useful for understanding the internal state of the pump and control circuit.

Figure 11:
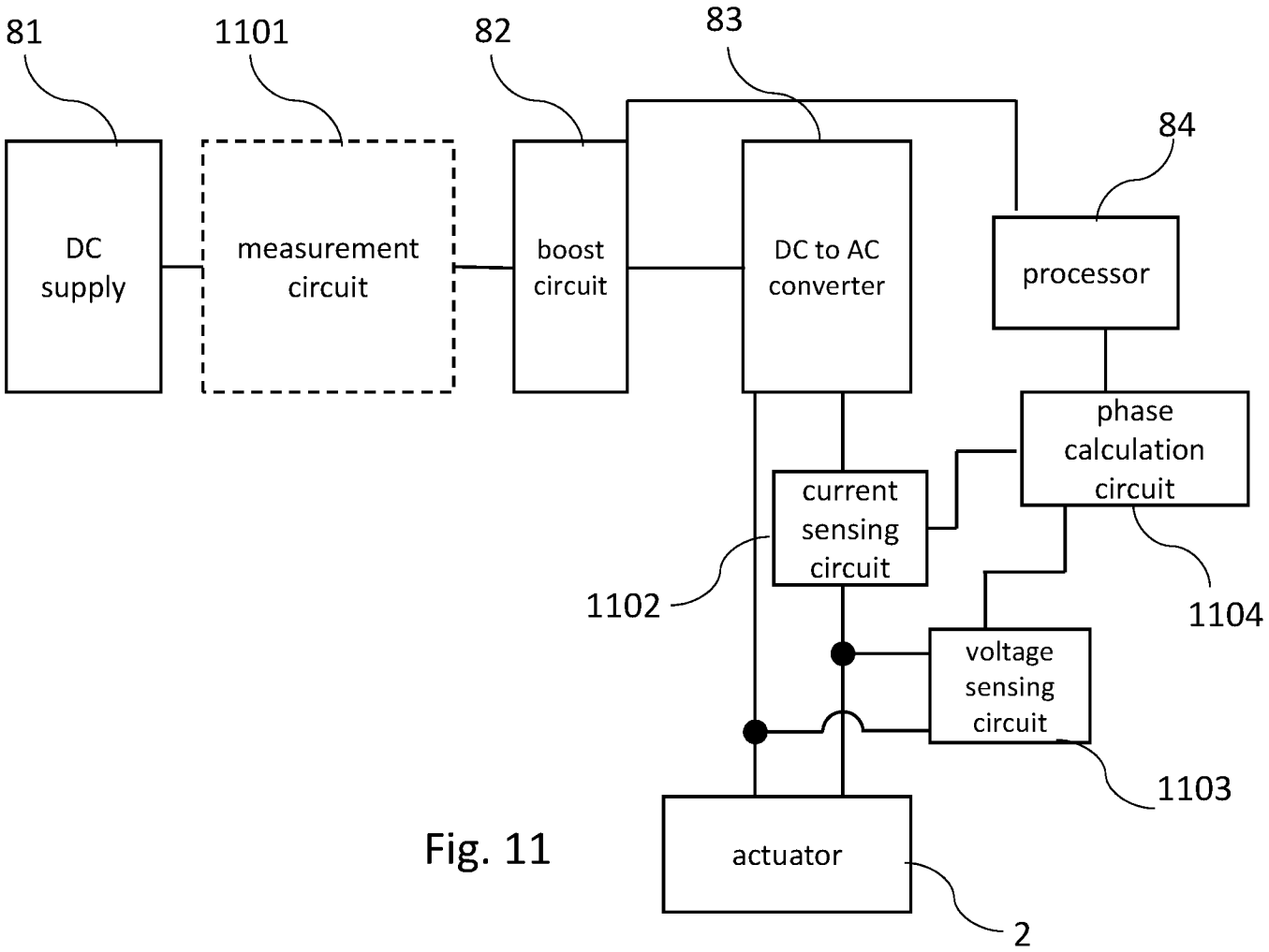
FIG. 11 is a further schematic block diagram showing further optional details of an example control circuit 3.

FIG. 11 is a further schematic block diagram showing further optional details of an example control circuit for controlling an actuator 2. The control circuit comprises a DC power supply 81, a boost converter 82, a DC-AC converter 83, and a processor 84 which may be as previously described by reference to FIGS. 1 and 8.

In the example control circuit of FIG. 11, between the DC power supply 81 and the boost circuit 82 is a measurement circuit 1101. The circuit 1101 may be used when the current drawn by the boost circuit is to be determined. For reference, similar circuits comprising a DC power supply 81, a boost circuit 82 and a measurement circuit 1101 are described in WO 2020/070498.

Additionally, between the DC-AC converter 82 and the actuator 2, the control circuit of FIG. 11 comprises a current sensing circuit 1102 and a voltage sensing circuit 1103. The positioning of the current sensing circuit 1102 and the voltage sensing circuit 1103 between the DC-AC converter 82 and the actuator 2 is suitable for the determination of the electrical phase shift induced by the pump.

The control circuit of FIG. 11 further comprises a phase calculation circuit 1104 which is configured to receive a current waveform measured by the current sensing circuit 1102 and a voltage waveform measured by the voltage sensing circuit 1103. The phase calculation unit 1104 performs calculations on the measured current and voltage waveforms in order to determine the relative electrical phase between the current and the voltage. The relative electrical phase is then passed to the processor 84.

The processor 84, possibly in combination with the memory 86 (shown in FIG. 8 but optional in FIG. 11), is configured to determine the drive frequency using the phase information passed by the phase calculation circuit 1104, as well as the drive voltage and drive waveform.

The measurements from the current-sensing circuit 1102 and the voltage-sensing circuit 1103 can be used by phase calculation circuit 1104 to calculate the phase as follows. Two sinusoidal waves sin ωt and cos ωt are generated in software by the phase calculation circuit 1104, with frequency ω equal to the drive frequency. The form of the voltage signal received from the voltage-sensing circuit is approximately of the form $V \sin(\omega t+\phi_{sw})$, where $\phi_{sw}$ is the phase shift between the measured voltage signal and the sinusoidal waves generated by the phase calculation circuit 1104. The voltage signal received is multiplied with the sinusoidal waves and integrated over some time T. The result of these calculations are:

$$V\int_0^T \sin(\omega t+\phi_{sw})\sin(\omega t)dt = \frac{V}{2}T\cos\phi_{sw} + \frac{V}{4\omega}\sin\phi_{sw} - \frac{V}{4\omega}\sin(\phi_{sw}+2\omega T)$$

$$V\int_0^T \sin(\omega t+\phi_{sw})\cos(\omega t)dt = \frac{V}{2}T\sin\phi_{sw} + \frac{V}{4\omega}\cos\phi_{sw} - \frac{V}{4\omega}\cos(\phi_{sw}+2\omega T)$$

The ratio of the two terms in the limit $T \gg \frac{1}{2}\omega$ is therefore equal to $R_V = \tan\phi_{sw}$. Similarly, the form of the current signal received from the current-sensing circuit is approximately of the form $I \sin(\omega t+\phi_{sw}+\phi+\phi_{delay})$, where $\phi$ is the electrical phase between the voltage signal and the current signal and $\phi_{delay}$ is the phase accumulated if the current and voltage readings are taken sequentially rather than simultaneously. The current signal received is multiplied with the sinusoidal waves and integrated over some time T. The result of these calculations are:

$$I\int_0^T \sin(\omega t+\phi_{sw}+\phi+\phi_{delay})\sin(\omega t)dt = \frac{I}{2}T\cos(\phi_{sw}+\phi+\phi_{delay}) + \frac{I}{4\omega}\sin(\phi_{sw}+\phi+\phi_{delay}) - \frac{I}{4\omega}\sin(\phi_{sw}+\phi+\phi_{delay}+2\omega T)$$

$$I\int_0^T \sin(\omega t+\phi_{sw}+\phi+\phi_{delay})\cos(\omega t)dt = \frac{I}{2}T\sin(\phi_{sw}+\phi+\phi_{delay}) + \frac{I}{4\omega}\cos(\phi_{sw}+\phi+\phi_{delay}) - \frac{I}{4\omega}\cos(\phi_{sw}+\phi+\phi_{delay}+2\omega T)$$

The ratio of the two terms in the limit $T>>\frac{1}{2}\omega$ is therefore equal to $R_I=\tan(\phi_{sw}+\phi+\phi_{delay})$. Thus we have $\phi+\phi_{delay}=\tan^{-1}(R_I)-\tan^{-1}(R_V)$. The term $\phi_{delay}$ can be calculated from knowledge of the sampling frequency. Therefore, using this method the phase-calculation circuit 1104 can effectively calculate the electrical phase between the voltage and the current. For applications where calculation speed is of crucial importance, approximations to the arctangent function may be used instead. The physical form of the phase calculation circuit 1104 may in general be of any form, for example consisting of a microcontroller, a processor, or any suitable hardware circuit.

In many applications, the limit $T>>\frac{1}{2}\omega$ may be undesirable as it may limit the speed at which the circuit can react to changes in the condition of the pump. Therefore, other methods may be used to increase the convergence speed of the integrals to the desired form. These can include performing the integration over a time period which equals an integer number of periods, using a windowing function, or using a filter (e.g. an exponential filter) to decrease the amplitudes of data points collected sufficiently far from the most recent data point obtained.

Once calculated, the electrical phase may be used to calculate a suitable indicator of the actuator velocity as described elsewhere in this patent.

As described above, the actuator 2 typically has a countably infinite number of higher-order resonant modes and, if a mode of the actuator is excited which is not the desired mode for which the pump geometry has been optimised, the transfer of energy from the actuator to the pump cavity or cavities is typically less efficient and the performance of the pump may be reduced.

Certain drive waveforms may contain harmonics which are capable of driving these undesirable modes. For example, a square wave contains harmonics at odd integer multiples of the fundamental frequency of the wave. If a square waveform is used to drive the actuator at a frequency different from the resonant frequency of the actuator, there is a risk that the harmonic content of the square wave excites one or more unwanted modes of the actuator, reducing the efficiency of the pump.

Various approaches may be used to mitigate unwanted actuator modes. For example, the control circuit may be configured to generate a tailored drive waveform, with problematic harmonic content removed. This may be achieved with one or more filters, such as a low-pass filter in line with the actuator 2.

Figure 12:
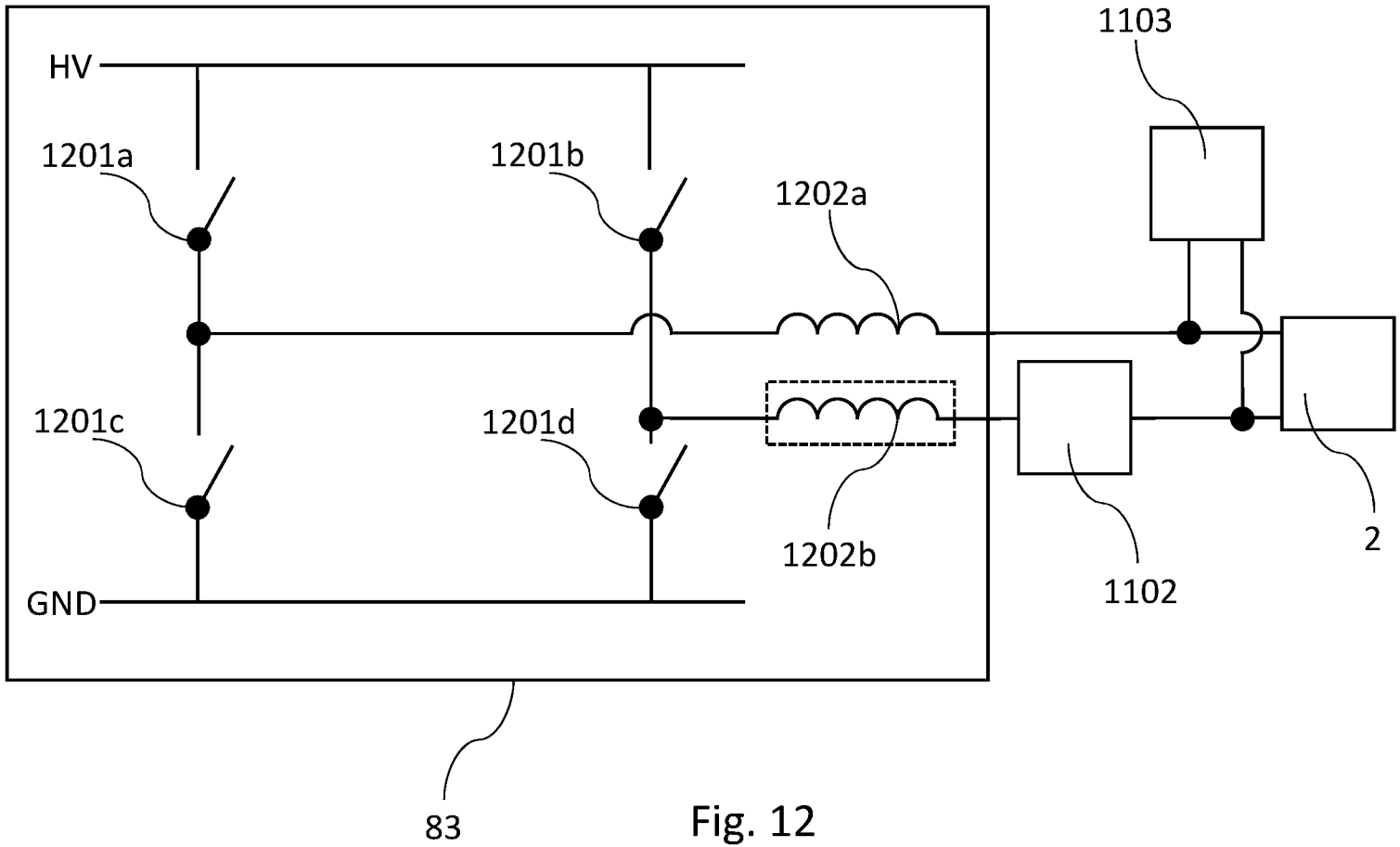
FIG. 12 is a further schematic block diagram showing further optional details of an example control circuit 3.

One preferred embodiment for the control circuit is schematically illustrated in FIG. 12. In the embodiment of FIG. 12, the actuator 2 is driven with a sine wave rather than a square wave. Sine waves have no harmonic overtones which can excite the unwanted modes of the actuator.

The control circuit of FIG. 12 comprises four switches 1201*a* to 1201*d*. The switches are arranged across a voltage divide between two voltage lines in an H-bridge pattern. The outputs of the H-bridge are ultimately connected to the actuator 2. Between the H-bridge and the actuator 2, the control circuit comprises a current sense circuit 1102, a voltage sense circuit 1103, and a first inductor 1202*a*.

During operation, the first inductor 1202*a* acts as a low pass filter, removing from the drive waveform any overtones beyond a predetermined cut-off frequency (which depends on the choice of the inductance value of the inductor). The interaction between the first inductor 1202*a* and the intrinsic capacitance of the actuator 2 also boosts the drive voltage across the terminals of the actuator 2, further increasing efficiency of the circuit.

The switches 1201*a*-1201*d* on the H-bridge may be triggered in such a way as to produce a waveform with few harmonics close to the desired frequency of operation. This may be achieved through any method, including amplitude modulation and pulse-width modulation. The switches 1201*a*-1201*d* may be of any suitable type, including transistors, FETS, and MOSFETs. Alternatively, the combination of the H-bridge and the inductor may be replaced by a Class D power amplifier.

The current-sensing circuit 1102 typically operates by measuring the voltage dropped across a shunt resistor. If the current-sensing circuit 1102 uses an op-amp circuit (for example, a differential amplifier or a difference amplifier) to measure this voltage, the switching of the H-bridge can lead to noise in the output of the amplifier. To suppress this effect, the optional second inductor 1202*b* may be added in series with the shunt resistor. The second inductor 1202*b* acts to reduce the common mode slew rate at the inputs to the op-amp, reducing any transients in the output of the measurement, and hence increasing the fidelity of the measurement.

Instead of using an H-bridge and two inductors, an alternative embodiment of the DC to AC converter 83 uses a half-bridge circuit and a single inductor. This has the double benefit of reducing the total number of components, and allowing the current sensing circuit 1102 to be placed close to ground, this substantially reduces the common-mode voltage across the inputs of the current sensing circuit 1102. The downside of this approach compared to an H-bridge is that the voltage of the high voltage rail needs to be increased by a factor of two, which may lead to difficulties with safety and with component sourcing and/or damage.

Because the drive waveform is approximately sinusoidal, the measurements performed by the current sensing circuit 1102 and the voltage sensing circuit 1103 may be taken with a sampling rate which is lower than the Nyquist frequency of the drive. This can be beneficial in order to reduce the demand on any processors 84, particularly during the phase calculation step. To maximise the effectiveness of the measurement when sampling below the Nyquist limit, the sample rate should not equal the ratio f/n, where f is the drive frequency and n is an integer, as this leads to repeatedly sampling the same regions of the measured waveform, giving a DC measurement not useful for phase calculation.

Figure 13:
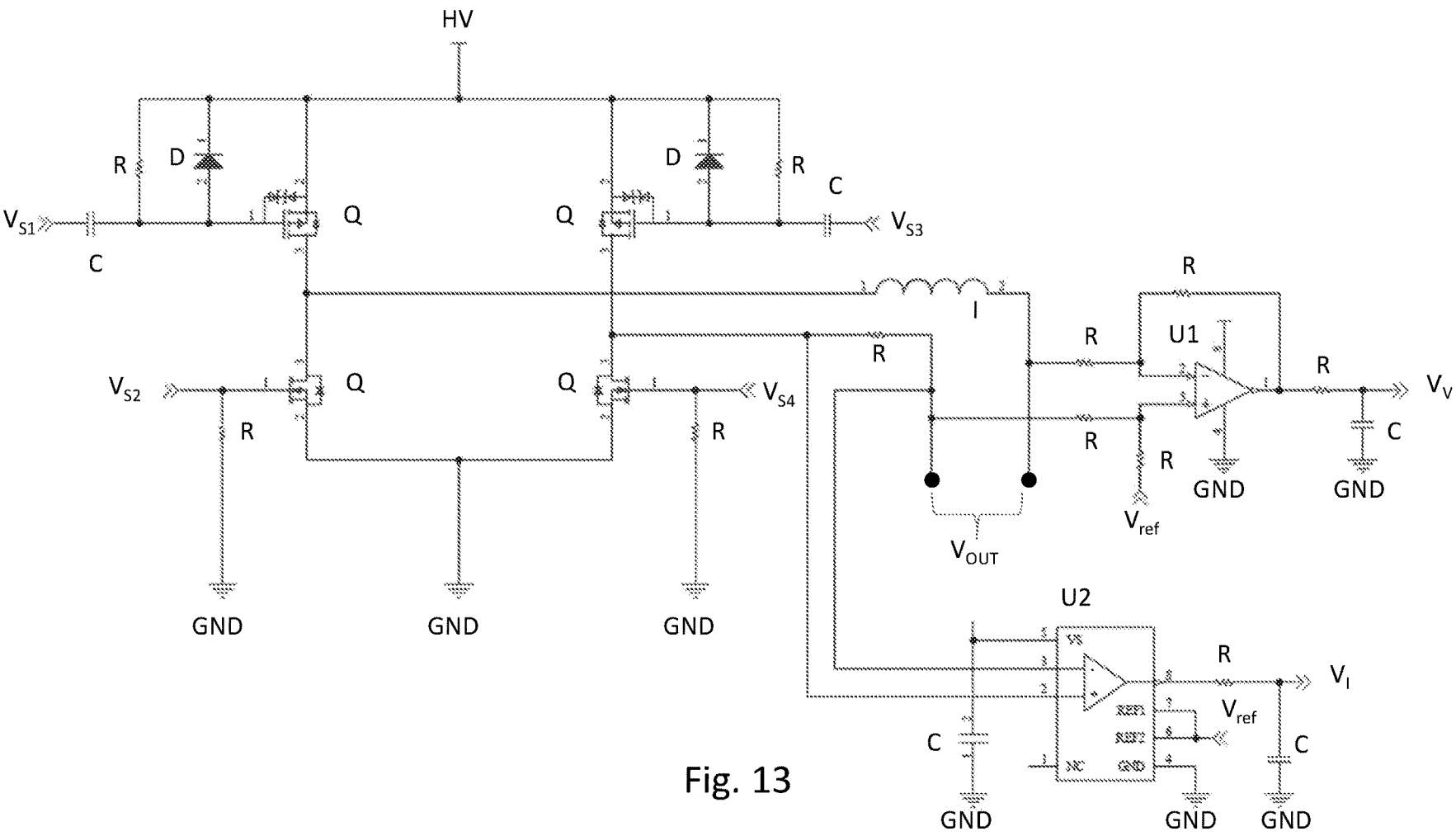
FIG. 13 is a further schematic block diagram showing further optional details of an example control circuit 3.

A more detailed preferred embodiment for the control circuit is schematically illustrated in FIG. 13.

In the embodiment of FIG. 13, the switches 1201*a* to 1201*d* are field effect transistors (FETs) labelled Q. The FETS are switched by control signals $V_{s1}$ to $V_{s4}$, where the control signal inputs are compared to a drive voltage reference HV or a ground reference GND via resistors R, and are protected with capacitors C and diodes D. The actuator 2 is driven by a signal $V_{OUT}$ across two output terminals of the control circuit. An inductor I corresponds to inductor 1202*a* of FIG. 12, and is connected between the switches 1201*a* to 1201*d* and one of the output terminals. The current-sensing circuit 1102 produces a current measurement output $V_I$ and comprises a difference amplifier U2 and a network of resistors R and capacitors C. The voltage sensing circuit 1103 produces a voltage measurement output $V_V$ and comprises an operational amplifier U1 and a network of resistors R and capacitors C. The voltage reference $V_{ref}$ can be used to include an offset in the voltage measurement output $V_V$.

While not shown explicitly in the figures, measurements of electrical parameters may be performed throughout the circuit to ensure the good operation of the device. In one example, the voltage generated by the boost circuit 82 may be monitored to give feedback to the microcontroller of the voltage setpoint. This is also useful as it can be used to maintain the voltage below the damage threshold of any vulnerable components.

As mentioned above, in some cases, the pump body 1 contains more than one cavity 12, and the actuator 2 may be arranged to drive one or both of the cavities, for example by dividing the internal volume of the pump body 2 into two cavities 12.

For such pumps, two or more minima in the peak velocity of the actuator may be detected using the methods described herein. This can be due to a fluid in a first cavity having different resonant frequency to a fluid in the second cavity—for example if the cavities have different internal dimensions. The drive frequency can be set to a frequency which matches a first minimum of peak velocity of the actuator, or which matches a second minimum of peak velocity of the actuator.

This can allow preferential driving of a first cavity with a resonant frequency corresponding to the first drive frequency, and preferential driving of a second cavity with a resonant frequency corresponding to the second drive frequency.

Figure 14:
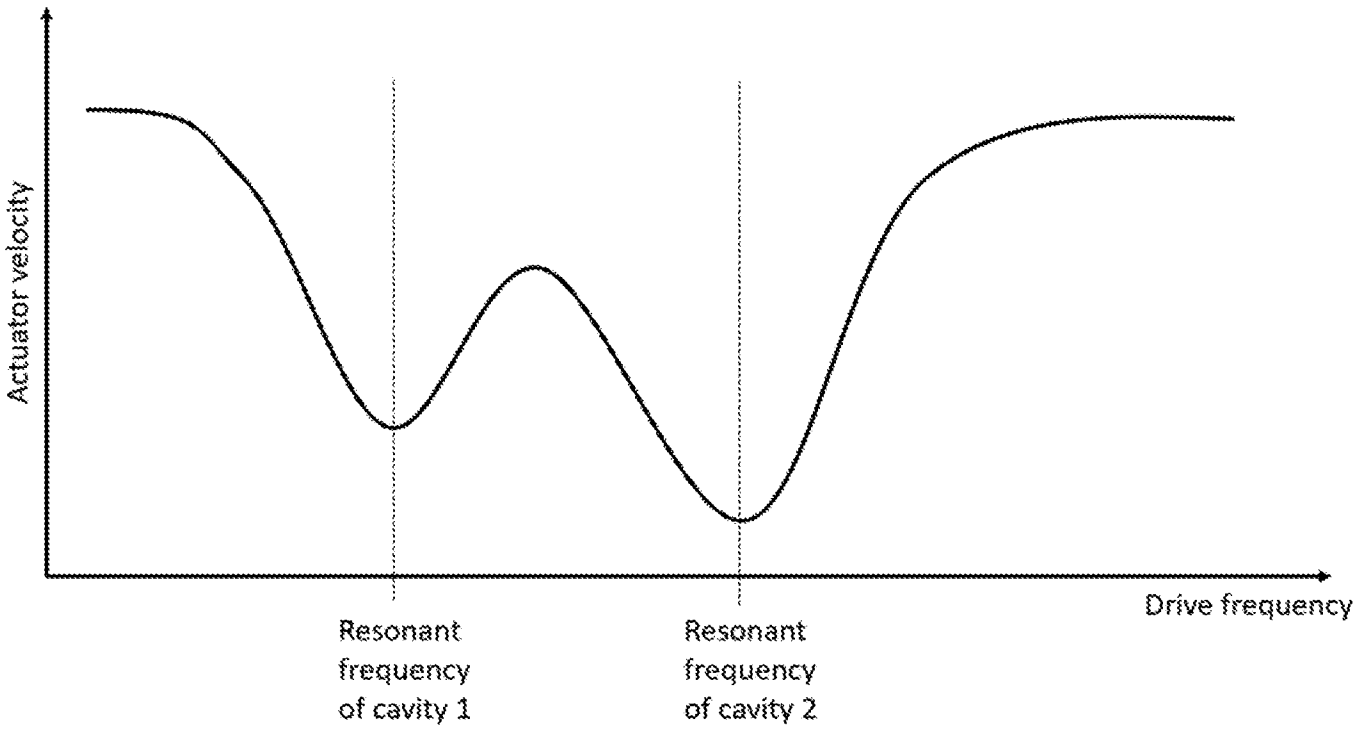
FIG. 14 is a plot of peak actuator velocity against drive frequency in an example where the pump body contains two cavities.

FIG. 14 schematically illustrates how peak actuator velocity varies by drive frequency in one example where the pump body 1 contains two cavities 12. In this case, a first cavity has a first resonant frequency f1, and a second cavity has a second resonant frequency f2, where f2>f1. When the drive frequency is controlled to be close to f1, the actuator 2 delivers energy more efficiently to the first cavity. On the other hand, when the drive frequency is controlled to be close to f2, the actuator 2 delivers energy more efficiently to the second cavity.

It will of course be understood by a skilled person that the present invention has been described above purely by way of example, and modifications of detail can be made within the scope of the invention. It should also be appreciated that particular combinations of the various features described and defined in any aspects described herein can be implemented and/or supplied and/or used independently. Any apparatus feature described herein may also be incorporated as a method feature, and vice versa.

The invention claimed is:

1. A method for controlling a microfluidic pump having a pump body defining a cavity, and an actuator arranged to generate pressure oscillations of a fluid contained within the cavity in order to cause fluid flow through an inlet and an outlet of the cavity, the method comprising:

oscillating the actuator at a first frequency and determining an indication of a peak velocity of the actuator at said first frequency;

oscillating the actuator at a second frequency and determining an indication of a peak velocity of the actuator at said second frequency; and adjusting a frequency of oscillation of the actuator to said first or second frequency for which a lowest peak velocity of the actuator was determined.

2. The method according to claim 1, wherein the microfluidic pump further comprises an electrical power supply for driving oscillation of the actuator, and the method comprises supplying a same power for driving oscillation of the actuator at the first frequency and at the second frequency when determining the peak velocity of the actuator.

3. The method according to claim 1, wherein the microfluidic pump further comprises a sensor for measuring a pressure across the pump, and the method comprises producing a same pressure across the pump at the first frequency and at the second frequency when determining the peak velocity of the actuator.

4. The method according to claim 1, wherein oscillation of the actuator is driven by an electrical signal, and the indication of the peak velocity of the actuator at said first frequency and/or said second frequency is obtained using feedback from the actuator in the electrical signal.

5. The method according to claim 4, wherein the electrical signal comprises an oscillating voltage and an oscillating current, and the indication of the peak velocity of the actuator at said first frequency and/or said second frequency is calculated using a phase difference between the oscillating voltage and the oscillating current.

6. The method according to claim 4, wherein the actuator has an intrinsic capacitance, the indication of the peak velocity of the actuator at said first frequency and/or said second frequency is calculated using the intrinsic capacitance.

7. The method according to claim 1, wherein the microfluidic pump further comprises an actuator motion sensor, and the peak velocity of the actuator at said first frequency and/or said second frequency is obtained using a signal from the actuator motion sensor.

8. The method according to claim 1, wherein the adjusting the frequency of oscillation of the actuator is repeated iteratively until the frequency of oscillation of the actuator is a first drive frequency at which both increasing and decreasing the frequency of oscillation of the actuator increases the peak velocity of the actuator.

9. The method according to claim 8, further comprising:

determining whether a characteristic of an electrical signal driving the actuator is in a required range at the first drive frequency; and if the characteristic is not in the required range, adjusting the frequency of oscillation of the actuator further until the frequency of oscillation of the actuator is a second drive frequency, different from the first frequency, at which both increasing and decreasing the frequency of oscillation of the actuator increases the peak velocity of the actuator.

10. The method according to claim 1, wherein the actuator is a piezoelectric actuator.

11. The method according to claim 1, wherein the first frequency is a predetermined expected resonant frequency of the fluid in the cavity.

12. A microfluidic pump, comprising:

a pump body defining a cavity, the cavity having an inlet and an outlet;

an actuator arranged to generate pressure oscillations of a fluid contained within the cavity in order to cause fluid flow through the inlet and the outlet of the cavity; and a control circuit configured to perform a method according to claim 1.

13. A storage medium storing processing instructions which, when executed by a control circuit of a microfluidic pump, causes the control circuit to perform a method according to claim 1.

* * * * *